US009094747B2

(12) United States Patent
Rayner

(10) Patent No.: US 9,094,747 B2
(45) Date of Patent: Jul. 28, 2015

(54) WEATHERPROOF LOUDSPEAKER AND SPEAKER ASSEMBLY

(71) Applicant: TreeFrog Developments, Inc., San Diego, CA (US)

(72) Inventor: Gary Rayner, San Diego, CA (US)

(73) Assignee: TREEFROG DEVELOPMENTS, INC., San Diego, CA (US)

( * ) Notice: Subject to any disclaimer, the term of this patent is extended or adjusted under 35 U.S.C. 154(b) by 0 days.

(21) Appl. No.: 13/954,965

(22) Filed: Jul. 30, 2013

(65) Prior Publication Data

US 2014/0029782 A1 Jan. 30, 2014

Related U.S. Application Data

(60) Provisional application No. 61/677,444, filed on Jul. 30, 2012.

(51) Int. Cl.
*H04R 1/02* (2006.01)
*H04R 1/28* (2006.01)

(52) U.S. Cl.
CPC ..... *H04R 1/02* (2013.01); *H04R 1/2834* (2013.01); *H04R 1/2896* (2013.01)

(58) Field of Classification Search
CPC ..... H04R 1/2834; H04R 1/2896; H04R 1/02
USPC ..... 381/386–389, 391, 394–395, 189, 396, 381/433, 124; 181/150, 199
See application file for complete search history.

(56) References Cited

U.S. PATENT DOCUMENTS

| | | | |
|---|---|---|---|
| 4,097,878 | A | 6/1978 | Cramer |
| 4,312,580 | A | 1/1982 | Schwomma et al. |
| 4,418,830 | A | 12/1983 | Dzung et al. |
| 4,584,718 | A | 4/1986 | Fuller |
| 4,649,453 | A | 3/1987 | Iwasawa |

(Continued)

FOREIGN PATENT DOCUMENTS

| | | | |
|---|---|---|---|
| JP | H04248799 | A | 9/1992 |
| WO | 9941958 | A1 | 8/1999 |

(Continued)

OTHER PUBLICATIONS

International Search Report mailed Oct. 31, 2013 for application No. PCT/US2013/052800.

(Continued)

*Primary Examiner* — Tuan D Nguyen
(74) *Attorney, Agent, or Firm* — Mintz Levin Cohn Ferris Glovsky and Popeo, P.C.

(57) ABSTRACT

A weatherproof loudspeaker includes a rigid enclosure having two or more sides, an interface between the sides being sealed sealing an internal space from an environment external to the rigid enclosure, and a sound projecting region formed on at least one side of the rigid enclosure. The sound projecting region includes an active driver speaker rigidly connected with the rigid enclosure, the active driver speaker to project sound outward from the sound projecting region and to reflect sound waves within the rigid enclosure. The speaker includes a flexible inner surround that frames the active driver speaker, and a passive radiator at least partially around the active driver speaker and connected between the inner surround and a flexible outer surround. The outer surround is connected with the rigid enclosure.

28 Claims, 8 Drawing Sheets

(56) References Cited

U.S. PATENT DOCUMENTS

| | | | |
|---|---|---|---|
| 4,994,829 | A | 2/1991 | Tsukamoto |
| 5,239,324 | A | 8/1993 | Ohmura et al. |
| 5,294,988 | A | 3/1994 | Wakabayashi et al. |
| 5,305,032 | A | 4/1994 | Arai |
| 5,380,968 | A | 1/1995 | Morse |
| 5,386,084 | A | 1/1995 | Risko |
| 5,508,479 | A | 4/1996 | Schooley |
| 5,713,048 | A | 1/1998 | Hayakawa |
| 5,713,466 | A | 2/1998 | Tajima |
| 5,845,803 | A | 12/1998 | Saito et al. |
| 6,138,826 | A | 10/2000 | Kanamori et al. |
| 6,304,459 | B1 | 10/2001 | Toyosato et al. |
| 6,349,824 | B1 | 2/2002 | Yamada |
| 6,396,769 | B1 | 5/2002 | Polany |
| 6,614,722 | B2 | 9/2003 | Polany et al. |
| 6,721,651 | B1 | 4/2004 | Minelli |
| 6,751,552 | B1 | 6/2004 | Minelli |
| 6,760,570 | B1 | 7/2004 | Higdon, Jr. |
| 6,778,388 | B1 | 8/2004 | Minelli |
| 6,819,866 | B2 | 11/2004 | Silva |
| 6,822,161 | B2 | 11/2004 | Komatsu et al. |
| 6,822,640 | B2 | 11/2004 | Derocher |
| 6,844,845 | B1 | 1/2005 | Whiteside et al. |
| 6,913,201 | B1 | 7/2005 | Wagner et al. |
| 6,953,126 | B2 | 10/2005 | Parker et al. |
| 6,954,405 | B2 | 10/2005 | Polany et al. |
| 6,983,130 | B2 | 1/2006 | Chien et al. |
| 6,987,527 | B2 | 1/2006 | Kossin |
| 7,050,712 | B2 | 5/2006 | Shimamura |
| 7,072,467 | B2 | 7/2006 | Ono |
| 7,082,264 | B2 | 7/2006 | Watanabe et al. |
| 7,158,376 | B2 | 1/2007 | Richardson et al. |
| 7,255,228 | B2 | 8/2007 | Kim |
| 7,263,032 | B2 | 8/2007 | Polany et al. |
| 7,366,555 | B2 | 4/2008 | Jokinen et al. |
| 7,369,881 | B2 | 5/2008 | Tsujimoto |
| 7,400,917 | B2 | 7/2008 | Wood et al. |
| 7,409,148 | B2 | 8/2008 | Takahashi et al. |
| 7,464,813 | B2 | 12/2008 | Carnevali |
| 7,889,498 | B2 | 2/2011 | Diebel et al. |
| 7,993,071 | B2 | 8/2011 | Clawson |
| 2004/0105565 | A1 | 6/2004 | Butters et al. |
| 2005/0134215 | A1 | 6/2005 | Bozzone et al. |
| 2007/0071423 | A1 | 3/2007 | Fantone et al. |
| 2007/0115387 | A1 | 5/2007 | Ho |
| 2007/0158220 | A1 | 7/2007 | Cleereman et al. |
| 2008/0094027 | A1 | 4/2008 | Cho |
| 2010/0298025 | A1 | 11/2010 | Spence |
| 2011/0077063 | A1 | 3/2011 | Yabe et al. |
| 2013/0195311 | A1* | 8/2013 | Sahyoun ..... 381/395 |

FOREIGN PATENT DOCUMENTS

| | | | |
|---|---|---|---|
| WO | 0051315 | A1 | 8/2000 |
| WO | WO-2012/051217 | A2 | 4/2012 |

OTHER PUBLICATIONS

International Search Report and Written Opinion dated Mar. 8, 2013, for PCT application No. PCT/US2012/071520.

* cited by examiner

200

200

200

WEATHERPROOF LOUDSPEAKER AND SPEAKER ASSEMBLY

CROSS-REFERENCE TO RELATED APPLICATIONS

This disclosure claims benefit of priority, under 35 U.S.C. §119, to U.S. Provisional Application No. 61/677,444 filed Jul. 30, 2012, the contents of which are hereby incorporated by reference.

BACKGROUND

A primary goal in loudspeaker, or simply "speaker," design has been sound quality. With the advent of mobile media players such as smart phones, iPods®, and other devices, there has been an effort to develop small profile loudspeakers, and in particular wireless loudspeakers that receive a stream of digital information to translate into sound via one or more driver speakers. However, such smaller loudspeakers typically sacrifice sound quality and/or frequency response due to their small size.

Typically, loudspeakers include an enclosure and at least one sound transducer, or active driver speaker having a driver surface or diaphragm, that produces sound waves by converting an electrical signal into mechanical motion of the driver diaphragm. An audible sound, or "sound wave", is produced by periodic pressure changes propagated through a medium, such as air. Sound transducers, such as active driver speakers, typically generate sound waves by physically moving air at various frequencies. That is, an active driver speaker pushes and pulls a diaphragm in order to create periodic increases and decreases in air pressure, thus creating sound. High-frequency sounds have small wavelengths, and thus require only small, fast air pressure changes to be produced for a given perceived loudness. On the other hand, low-frequency sounds have large wavelengths, and accordingly require large, slow air pressure changes for the same perceived loudness. The size of the pressure change is dependent on the amount of air the sound transducer or active driver speaker can move at a desired frequency. In general, a small, lightweight diaphragm is efficient at producing high frequencies because it is small and comparatively lightweight, but may be inefficient at moving sufficient air to produce low frequencies. In contrast, a large diaphragm may be well suited for moving a large amount of air at low frequencies, but not fast enough to produce high frequencies efficiently. Thus, where space is available, many systems employ more two or more active driver speakers of different sizes in order to better achieve a flat frequency response across a wide frequency range.

The diaphragm of an active driver speaker vibrates in two directions, producing a sound wave at one side (front) of the diaphragm that is 180 degrees out of phase with a sound wave produced at the other side (rear). Since identical sound waves 180 degrees out of phase cancel each other, a "baffle" or wall is employed to separate the front and back sound waves to prevent the rear sound wave from canceling the front sound wave. The baffle is incorporated into a box, as (an ideally) infinite-sized baffle is physically impractical. A "sealed box" system removes almost all effects of the rear sound wave. However, unless additional measures are taken, such a "sealed box" system inefficiently permits only half of the sound waves (i.e., the front sound waves) produced by the active driver speaker to be used.

One technique for improving sound quality and taking advantage of the sound waves produced at the rear of an active driver speaker, particularly at low frequencies, is to introduce one or more tuned ports through a wall (usually a front (baffle) or rear face) of the speaker enclosure. The port, also known as a duct or vent in a bass reflex system, is a passive device. That is, it does not receive an electrical signal as would an "active" device such as an active driver speaker. Each tuned port typically includes a cylindrical tube that penetrates the wall of the enclosure at one end and extends into the enclosure at the other end. Such a cylindrical tube has a cross-sectional area and length that together are configured or "tuned" to determine a range of frequencies at which the cylindrical tube may resonate and vent air, generally enhancing the lower frequencies and the overall sound reproduction in general. Much like when a person blows across the opening of a jug, the compression and rarefaction of air in the enclosure due to the active driver speaker's movement produces sound at the tuned port. The tuning of the port addresses the phase differences between the front and back sound waves and thus permits the rear sound wave to be utilized, thus increasing efficiency and enhancing the range of frequencies to which the port(s) are tuned. This permits enhanced response at the lower frequency range and/or permits use of active driver(s) that are less responsive at lower frequency due to size or quality.

However, openings, such as sound ports, in the enclosure are, by definition, holes in the enclosure, and are not sealed or weatherproof because sealing closes and impedes the sound port, thus inhibiting inward and outward airflow from within the speaker enclosure via the sound port and therefore causing distortion. In addition to unsuitability for sealed, weatherproof implementations, use of tuned sound ports limit the size and geometry of an enclosure into which they are placed because the low frequencies to which they are tuned typically require large port length and/or diameter, and thus large enclosures.

Another technique for improving frequency response, and therefore sound quality, in a loudspeaker is to use a different passive device called a passive radiator, or passive diaphragm. Like active drivers, passive radiators typically include a sound radiating surface, or diaphragm, attached via a suspension mechanism to a support structure and/or wall of the speaker enclosure. The radiator surface and suspension mechanism are typically tuned by their mass, flexibility/compliance, and surface area to move in response to compression and rarefaction of air in the enclosure, which results from movement of the active driver(s). Movement of the radiator surface causes movement of air outside the enclosure, which causes sound to be generated at the movement frequency. However, passive radiators are more expensive than sound ports, require more complex configuration due to the method of tuning (typically by adding weight to the radiator surface), and typically require large surface areas (at least two times the surface area of the active driver speakers), thereby requiring a larger enclosure.

Moreover, conventional small-size loudspeaker designs that implement a passive radiator are limited by the surface area of an enclosure and/or by an undesirable radiating direction resulting from a non-ideal placement of the conventional passive radiator. For example, a small-size loudspeaker design may use a necessarily small passive radiator in a front baffle in order to fit between active driver speakers, or may use a rear-directed passive radiator in order to take advantage of additional surface area unimpeded by active driver speakers. These configurations are less than ideal, resulting in a deficiency of sound quality.

So far, there is no wireless loudspeaker that is small and compact, completely enclosed and sealed so to be weatherproof, and providing high sound quality. The devices, systems, and methods disclosed herein are designed to overcome these deficiencies.

SUMMARY

The present disclosure describes a weatherproof loudspeaker speaker and speaker assembly that may be sealed from an external environment of the loudspeaker, thereby allowing it to be used in a multiplicity of environments. In accordance with certain embodiments disclosed herein, the loudspeaker of the disclosure can be waterproof, shockproof, and/or sealed against intrusion of dust, dirt or sand. Further, the weatherproof loudspeaker described herein can be fashioned so as to have a small profile and size. For instance, a weatherproof loudspeaker of the disclosure may utilize a unique configuration of a passive radiator that economizes and conserves surface area of a sound projecting region. Additionally, the weatherproof loudspeaker disclosed herein provides high sound quality as well as desirable frequency response across a predetermined wide frequency range that includes low audio frequencies.

The loudspeaker disclosed herein may include a rigid enclosure and a speaker assembly. The rigid enclosure may have a small size and/or small enclosure volume. In various embodiments, the loudspeaker may be sealed, for instance by one or more waterproof/weatherproof seals provided in openings of the rigid enclosure and between the rigid enclosure and the speaker assembly. The rigid enclosure may also include a portion that houses electronic circuitry, such as an amplifier, device-to-device communications electronics, and/or control electronics for controlling loudness, tone, input selection and the like, as described in detail below.

In one embodiment, the speaker assembly may include at least one type of structural support for supporting, within and with respect to the rigid enclosure, at least one active driver speaker that converts an electrical signal into audible sound and at least one passive radiator that radiates sound in passive response to air pressure changes within the rigid enclosure that are caused by movement of the active driver speaker. The structural support rigidly connects a portion of the active driver speaker to the rigid enclosure so that a sound-projecting surface of the active driver speaker may move efficiently relative to the rigid enclosure. The structural support may also connect a portion of the passive radiator to the rigid enclosure. For example, the structural support may include a rigid frame that attaches at one portion thereof to a non-moving rear element of the active driver speaker and attaches at another portion thereof to one or more walls of the rigid enclosure. A perimeter of the rigid frame may define a sound projecting region within which the active driver, passive radiator, and suspension elements move and, in combination, project sound from the weatherproof loudspeaker. The rigid frame may support the active driver speaker(s) and components of the passive radiator(s). In some embodiments the rigid frame may include a minimal set of arms or spindles spreading from a central common point outward toward distinct points at the perimeter of the rigid frame. In other embodiments, the rigid frame may include a substantial structure such as a rigid plate- or dish-shaped structure having minimal openings to permit air to move between the sound-producing diaphragms of the active driver speaker and the passive radiator. The structural support in some embodiments may also include a tube, rod, or other structure rigidly fixed to and extending backward from the back of the active driver speaker to attach to a rear wall of the rigid enclosure as will be described in further detail below.

In another embodiment the structural support may include a "basket" as is commonly used in the art for support of active driver speaker components. For example the basket provides a platform upon which non-moving elements of the active driver speaker are rigidly fixed. The basket also operates as a mounting chassis that may be rigidly connected to the rigid enclosure and/or to the rigid frame. The basket may define a perimeter of the active driver speaker which provides structural strength between the rigid enclosure and the active driver speaker.

For example, an active driver speaker having such a basket may support a driving mechanism such as a permanent magnet of a voice coil assembly and spider (described below) at a central, inner side and may attach to the rigid enclosure at a peripheral outer side and a driver surround to which the movable driver diaphragm is connected for suspension at a peripheral inner side. The basket may be used with or without the rigid frame. The active driver speaker may be attached to the rigid enclosure or rigid frame at a front, peripheral portion of the basket, may be attached at a rear portion of the active driver speaker to a rear wall of the rigid enclosure, or may be supported by internal bracing or the rigid frame at a lateral portion of the active driver speaker. In some instances the rigid frame may support the speaker assembly from a rear wall of the rigid enclosure. The rigid frame may, for example, comprise a rigid cylinder fixed at one end to the rear wall of the rigid frame, and fixed at the other end of the cylinder to a rear portion of the speaker assembly.

The sound projecting region of the speaker assembly may include an active driver speaker that may or may not be rigidly connected to the rigid frame and/or basket. In such an instance, the active driver speaker may be configured to project sound outward from the sound projecting region by movement of a driver diaphragm and to compress and rarefy air within the rigid enclosure behind the sound projecting region. The speaker assembly may further include an inner surround formed of a first flexible material that frames the active driver speaker and a "spider", which is formed in a flexible manner and/or using a flexible material to connect around a base of the driver diaphragm and a top portion of a voice coil. The inner surround and spider, provided at distinct extents of the driver diaphragm, permit the driver diaphragm to move in and out in a physically linear fashion. These suspension elements also limit the extent to which the driver diaphragm and attached voice coil may travel in and out with respect to the permanent magnet.

In disclosed embodiments, the speaker assembly further may include a passive radiator that may be positioned at least partially around the inner surround of the active driver speaker and/or connected between the inner surround and an outer surround, such as an outer surround formed of a second flexible material. In such instance, the outer surround may be connected with the rigid frame. In certain instances the passive radiator may have a surface area and a mass that together can be tuned to constructively react to the active driver speaker's compression and rarefaction of the air in the rigid enclosure. The surface area and mass may be selected and tuned, for example, to enhance at least a portion of the frequency spectrum that the active driver speaker projects. In certain instances the passive radiator may be tuned to have a resonant frequency below the audible frequency range of the active driver speaker so as to enhance projection of the sound waves from the sound projecting region and thereby to increase the overall sound quality of the loudspeaker. At least one additional passive radiator may be included in another wall of the rigid enclosure, either coincident with one or more active driver speakers or alone in order to increase the total radiating surface area of the passive radiators. With more radiating surface, more air is moved exterior to the weatherproof loudspeaker, and/or less movement is necessary to move the same amount of air, thus increasing the low-frequency efficiency of the weatherproof loudspeaker and making efficient use of the rigid enclosure surface area, thus providing a solution to the problem of obtaining good sound quality in a small package.

A weatherproof loudspeaker according to disclosed embodiments may include a rigid enclosure that may be sealed from an external environment, e.g., by being sealed against ingress of dust, water, and air. The rigid enclosure of the weatherproof loudspeaker may be formed in any of multiple geometries, including a closed chamber of, for example, rectangular, triangular, pyramidal, circular, semi-spherical, tubular, and/or other geometry, and/or or combinations thereof, sufficient to provide a closed chamber having a wall from which an active driver speaker and/or a passive radiator may project sound. The weather proof loudspeaker may include a sound projecting region formed on at least one side of the rigid enclosure. The sound projecting region may include an active driver speaker that converts an electrical signal to audible sound as described herein. The active driver speaker may, in some instances, be rigidly connected with the rigid enclosure, and may be arranged to project sound outward from the sound projecting region and to compress and rarefy air within the rigid enclosure via movement of a diaphragm of the active driver speaker.

The weatherproof loudspeaker may further include an inner surround formed of a first flexible material that frames the active driver speaker, and providing a suspension for a diaphragm of the active driver speaker, permitting the diaphragm of the active driver speaker to have sufficient excursion toward and away from the rigid enclosure to produce sound waves within one or more desired frequency ranges, while maintaining rigidity of the diaphragm material itself and maintaining a barrier between the interior and exterior of the rigid enclosure. Formed of a weatherproof material, the inner surround contributes to the weatherproof aspects of the weatherproof loudspeaker both by closing a gap between the active driver speaker diaphragm and the passive radiator or a structural feature. The weatherproof loudspeaker may additionally include a passive radiator positioned at least partially around the active driver speaker, which may be connected between the inner surround and an outer surround formed of a second flexible material. The outer surround may be connected either directly with the rigid enclosure or connected with a support structure that in turn is connected with the rigid enclosure. The passive radiator and outer surround may be formed of weatherproof materials and connected to each other in a weatherproof manner as described herein, thus further contributing to the weatherproof aspects of the weatherproof speaker.

In certain instances, the passive radiator may be configured with a surface area and a mass that may be tuned with respect to each other and with respect to predetermined sonic requirements so as to enhance at least a portion of a sound frequency range projected by the active driver speaker. For example, the passive radiator may project sound in low frequency ranges that are produced by the active driver speaker only at low levels compared with higher frequencies. Thus, the sound quality, particularly at low frequencies, may be enhanced appropriate tuning of the passive radiator. In some implementations, the first flexible material and the second flexible material are the same. In other implementations, they are formed of different materials as described in further detail herein.

In various aspects, the weatherproof loudspeaker may include electronics that facilitate communications with an external communication device such as a smart phone, media player, laptop computer, personal digital assistant, wearable computer, and the like. For example, the weatherproof loudspeaker may include various radios, antennas, processors, memory, etc. configured to communicate by wire or wirelessly with an external device via USB, Wi-Fi, Bluetooth®, Zigbee®, and/or other communication protocols. Such communications may permit control of the device for: charging an internal battery, receiving media content for playback, controlling loudness/volume, setup for additional communications (e.g., with one or more additional loudspeakers) and the like. Details of the communication and control aspects are discussed in further detail below.

The weatherproof loudspeaker may further include various features for providing data and/or notifications to users. For example, one or more visual notification elements may provide information regarding battery level, connection/bonding with an external device (such as a smart phone or other speaker), power status, time of day, media content metadata, etc. In some implementations, the electronic circuitry may include a processor, random access memory and non-transient memory, logic circuits, sensors, voltage regulators, communication radios, visual indicators and/or other components configured to execute an operating system and software applications. For instance, the operating system may cause a display panel of the weatherproof loudspeaker to display functions consistent with the operating system and built-in, default, and/or user-selectable applications. For example, the processor may execute one or more applications that manage playlists, storage of media, custom playback settings such as equalization and other sound processing, and the like. For example, the processor may control communication to obtain and store in memory one or more software applications related to sound reproduction. The processor may execute instructions of a software application to, for example, detect and analyze metadata associated with a media file such as a recorded music file. The processor may utilize such metadata to, for example, effect display of the metadata and/or to detect a music genre in order to implement an equalization profile as further described below. In other implementations, such applications may be executed by an external device such as a smart mobile telephone or other media playback device capable of communicating with the weatherproof loudspeaker, where data provided from the external device may be used at the weatherproof loudspeaker to control/affect/provide playback of media content, notify users, and/or to display information.

The details of one or more embodiments are set forth in the accompanying drawings and the description below. Other features and advantages will be apparent from the description and drawings, and from the claims.

In one aspect, a weatherproof speaker is provided. The weatherproof speaker includes a rigid enclosure having an outer wall that has at least one sealing member configured to prevent ingress of liquids and particulate matter into the rigid enclosure from an external environment. The weatherproof speaker also includes a liquid-impermeable sound projecting region formed in the outer wall of the rigid enclosure and sealed from the external environment. The liquid-impermeable sound projecting region includes: an active driver speaker having a voice coil assembly, the voice coil assembly including a permanent magnet and a voice coil, the voice coil assembly being connected with the rigid enclosure to limit movement of the voice coil assembly relative to the rigid enclosure. The active driver speaker further has a driver diaphragm configured to be driven by the voice coil to project sound waves outward from the rigid enclosure via a front surface of the driver diaphragm and to modulate air within the rigid enclosure via a rear surface of the driver diaphragm. The sound projecting region also includes: an inner surround that frames the active driver speaker, the inner surround being formed of a first flexible material; and a passive radiator at least partially surrounding the active driver speaker and connected between the inner surround and an outer surround formed of a second flexible material. The outer surround is connected with a structural support frame of the sound projecting region, the structural support frame being securely fixed to the rigid enclosure, the passive radiator having a rigid diaphragm with surface area and a mass that together are configured to tune the passive radiator to have a resonant frequency below a frequency range reproduced by the active driver speaker in the box, the passive radiator configured to enhance at least low-frequency sound waves of the active driver speaker.

In certain embodiments of the foregoing aspect, to modulate the air includes compression and rarefaction of the air. In certain embodiments, the permanent magnet of the voice coil assembly is connected with the rigid enclosure to prevent movement of the permanent magnet and the voice coil relative to the rigid enclosure. In some embodiments, the active driver speaker, passive radiator and inner and outer surrounds provide a seal between an interior of the rigid enclosure and the external environment exterior of the rigid enclosure. In some embodiments, the enhanced low frequency sound waves are in a frequency range between 20 and 100 hertz. In some embodiments, a range of the low-frequency sound waves to be enhanced is based in part on a volume of the rigid enclosure. In certain embodiments, the range of low-frequency sound waves to be enhanced by the passive radiator is based in part on a determined amount of flexibility of the inner and outer surrounds. In some embodiments, a desired frequency response of the passive radiator is characterized at least in part based on the mass of the passive radiator diaphragm, respective flexibility amounts of the inner and outer surrounds, and a volume of the rigid enclosure.

In some embodiments of the foregoing aspect, at least one of the active driver speaker diaphragm and the passive radiator diaphragm is translucent. In some embodiments, the weatherproof loudspeaker further includes one or more light sources housed within the rigid enclosure.

In certain embodiments of the foregoing aspect, the structural support includes a cylinder affixed at a first cylinder end to a rear portion of the active driver speaker and affixed at a second cylinder end to a wall of the rigid enclosure. In some embodiments, the weatherproof loudspeaker further includes a gas permeable, liquid-impermeable vent formed in the rigid enclosure.

In another aspect of the instant technology, a speaker assembly is provided. The speaker assembly includes: a rigid frame that defines a sound projecting region; and an active driver speaker rigidly connected with the rigid frame, the active driver speaker being configured to project sound waves outward from the sound projecting region and to project sound waves rearward from the sound projecting region. The speaker assembly also includes: an inner surround formed of a first flexible material that frames the active driver speaker; and a passive radiator at least partially surrounding the active driver speaker and connected between the inner surround and an outer surround formed of a second flexible material. The outer surround is connected with a perimeter of the rigid frame, and the passive radiator having a surface area and a mass that together are configured to tune the passive radiator to have a resonant frequency below a frequency range produced by the active driver speaker. The passive radiator is also configured to enhance outward projection of a portion of the frequency range produced by the active driver speaker from the sound projecting region.

In some embodiments of the speaker assembly, the active driver speaker includes a truncated-cone shaped diaphragm to project sound outward from the sound projecting region and to project the sound waves rearward. In certain embodiments, the active driver speaker, the inner and outer surrounds and the passive radiator provide a weatherproof seal for the sound projecting region.

In yet another aspect of the present technology, a weatherproof loudspeaker is provided that includes: a rigid enclosure having two or more sides, an interface between two of the two or more sides being sealed to prevent ingress of liquid and particulate matter to an internal space of the rigid enclosure from an environment external to the rigid enclosure; and a sound projecting region formed on at least one side of the rigid enclosure. The sound projecting region includes: two or more active driver speakers rigidly connected with the rigid enclosure, each of the two or more active driver speakers configured to project sound waves outward from the sound projecting region and to project sound waves rearward within the rigid enclosure; an inner surround formed of a first flexible material that respectively frames each of the two or more active driver speakers; and a passive radiator positioned at least partially surrounding both of the two or more active driver speakers and connected between each inner surround and an outer surround formed of a second flexible material. The outer surround is connected with the rigid enclosure, and the passive radiator has a surface area and a mass that together are configured to tune the passive radiator to have a resonant frequency below a frequency range produced by the active driver speakers. The passive radiator is configured to enhance outward projection of a portion of the frequency range produced by the active driver speaker from the sound projecting region.

In some embodiments of the foregoing aspect of the weatherproof speaker, the two or more active driver speakers, passive radiator, and inner and outer surrounds together provide a liquid-impermeable and particle-impermeable seal between an interior of the rigid enclosure and the environment external to the rigid enclosure. In certain embodiments, the enhanced portion of the frequency range of the active driver speaker includes frequencies between 20 and 100 hertz. In some embodiments, the enhanced portion of the frequency range of the active driver speaker is based in part on a volume of the rigid enclosure. In certain embodiments, the projection of the enhanced portion of the frequency range of the active driver speaker by the passive radiator is based in part on the flexibility of the inner and outer surrounds. In some embodiments, a desired frequency response of the passive radiator is characterized at least in part based on the mass of the passive radiator, an amount of flexibility of the inner and outer surrounds, and a volume of the rigid enclosure.

In certain embodiments of the foregoing aspect, at least a diaphragm of the passive radiator is formed of a translucent material. In some embodiments of the foregoing aspect, the weatherproof loudspeaker further includes one or more light sources housed within the rigid enclosure, the one or more light sources being positioned to permit direct or reflected light emitted by the one or more light sources to be transmitted through at least the translucent diaphragm. In some embodiments of the foregoing aspect, the weatherproof loudspeaker further includes a support frame connected between each of the two or more active driver speakers and the rigid enclosure. In some embodiments, the support frame includes a tube having at least one aperture to allow passage of air within the rigid enclosure.

Still another aspect of the present technology provides a weatherproof loudspeaker. The weatherproof loudspeaker includes: a rigid enclosure having a sound projecting region; and two or more active driver speakers each mounted in the sound projecting region via a respective inner surround, each active driver speaker having a cone-shaped diaphragm configured to project sound outward from the sound projecting region and to compress and rarefy air within the rigid enclosure, each active driver speaker having a predetermined mass. The weatherproof loudspeaker also includes a passive radiator connected between a flexible suspension and the inner surrounds of the two or more active driver speakers. The passive radiator is formed to cooperate with the inner surrounds and the two or more active driver speakers. The passive radiator is configured to react to the compressed and rarefied air to project at least a portion of the reflected sound waves within the rigid enclosure outward from the sound projecting region as sound waves within a predetermined frequency range at a predetermined frequency response.

In certain embodiments of the foregoing aspect, at least a diaphragm of the passive radiator is formed of a translucent material. In some embodiments of the foregoing aspect, the weatherproof loudspeaker further includes one or more light sources housed within the rigid enclosure, the one or more light sources being positioned to permit direct or reflected light emitted by the one or more light sources to be transmitted through at least the translucent diaphragm.

Another aspect of the present technology provides a weatherproof loudspeaker including: a rigid enclosure having an outer wall that is sealed to inhibit ingress of water and particulate matter from an external environment and having a sound projecting region; and one or more speaker assemblies, each speaker assembly including at least one active driver speaker, each active driver speaker having a diaphragm movable to project sound outward from the sound projecting region and to compress and rarefy air within the rigid enclosure, each active driver speaker having a predetermined mass. The weatherproof speaker also includes: a flexible suspension that frames at least part of the sound projecting region; and a passive radiator connected between the flexible suspension and the one or more speaker assemblies. The passive radiator is formed to cooperate with the flexible suspension and the one or more speaker assemblies to project sound waves outward from the sound projecting region based on the compression and rarefaction of air within the rigid enclosure within a predetermined frequency range.

In some embodiments of the foregoing aspect, the weatherproof loudspeaker further includes a second flexible suspension framing an outer periphery of the passive radiator.

In certain embodiments of the foregoing aspect, at least a diaphragm of the passive radiator is formed of a translucent material. In some embodiments of the foregoing aspect, the weatherproof loudspeaker further includes one or more light sources housed within the rigid enclosure, the one or more light sources being positioned to permit direct or reflected light emitted by the one or more light sources to be transmitted through at least the translucent diaphragm

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a loudspeaker device that is sealed from an external environment. In some implementations, the loudspeaker device may include a sealed, rigid enclosure that is sealed from the external environment so as to be waterproof, shockproof, and/or sealed against intrusion of dust, dirt or sand by use of materials and construction methods that ensure such utility, as described below. Disclosed implementations may also address the sonic shortcomings of conventional small-size loudspeakers by including a unique passive radiator design that makes efficient use of at least loudspeaker surface area that is coincident with the active driver speaker(s) to include a passive radiator. This design extending the frequency response and directivity of the loudspeaker and thus sound quality, of the loudspeaker.

Figure 1:
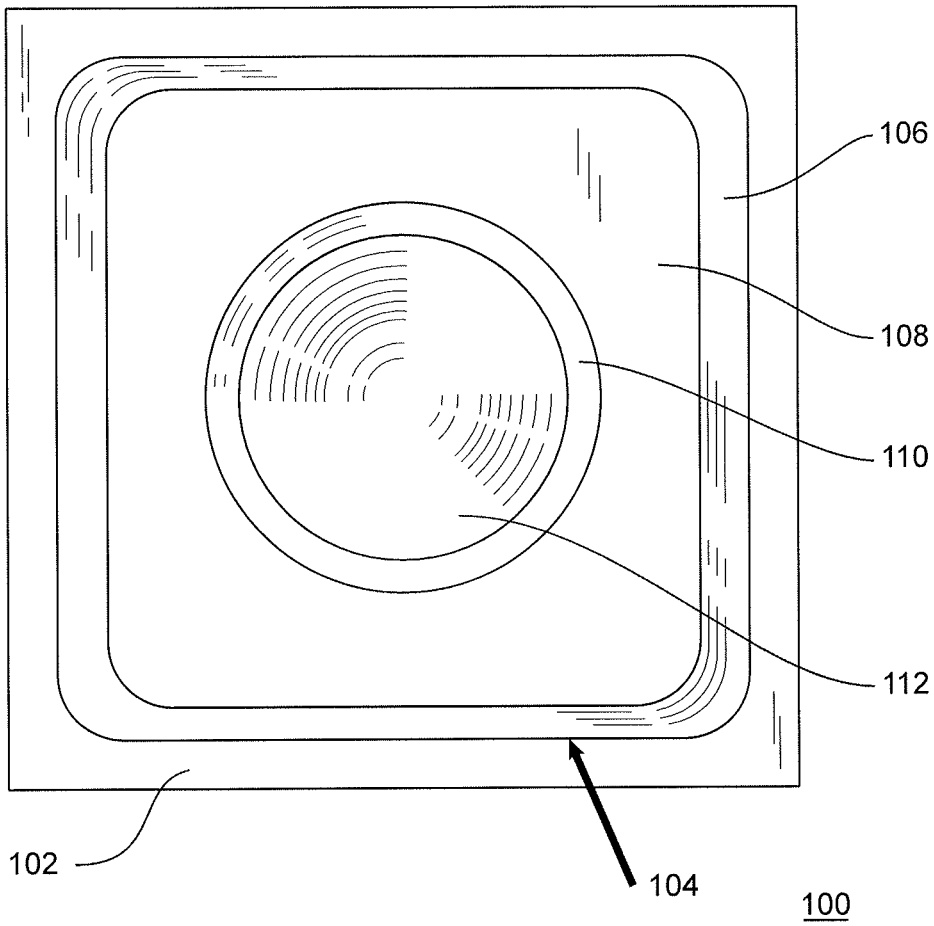
FIG. 1 illustrates a speaker in accordance with implementations.

FIG. 1 illustrates a general implementation of a weatherproof loudspeaker 100. The speaker 100 is sealed against the outside environment, and is therefore resistant to water, dust, and/or other particulates. The speaker 100 includes a rigid enclosure 102 that is sealed from an environment external to the speaker 100. For instance, the speaker 100 may be configured to provide no openings through which water, dust, etc. may enter. The materials from which the speaker 100 is formed may themselves be water and/or dust resistant and/or waterproof and interfaces between distinct parts at the surface of the speaker 100 may be sealed by welding, gasket, seals, adhesives, etc. Any necessary openings, such as electrical connections, may be weatherproof and sealed with respect to the loudspeaker 100, and/or may include a bung or plug configured to block entry of liquids, dust, etc. Accordingly, the sealed nature of the enclosure prevents or substantially resists ingress of dust, water, air, and the like into the rigid enclosure. The rigid enclosure 102 defines and includes a sound projecting region 104 from which sound may emanate when engaged. The sound projecting region utilizes sound producing elements, as described below, to provide sound in a predetermined frequency range at predetermined minimum frequency response across the frequency range. The sound projecting region 104 is at least partially or completely framed by a first, or outer, surround 106, which is formed of a flexible, waterproof material as described below. The speaker 100 may further include a passive radiator 108 having an outer periphery that is connected with the outer surround 106.

The sound projecting region 104 of the speaker 100 further includes a second, or inner, surround 110 connected with an inner periphery of the passive radiator 108. The inner surround 110 is also formed of a flexible, waterproof material. The sound projecting region 104 of the speaker 100 further includes an active driver speaker 112 connected at an outer periphery with the inner surround 110. The active driver speaker 112 includes a voice coil configured to receive an electrical signal which causes the voice coil to magnetically interact with a permanent magnet (shown as element 220 in FIGS. 2A, 2B), thus driving and vibrating a driver diaphragm (e.g., cone 218 in FIGS. 2A, 2B) that projects sound waves outward from a front side of the active driver speaker 112 and from the sound projecting region 104. A back side of the active driver speaker 112 may be at least partially exposed to the interior of the rigid enclosure 102 such that the movement of the driver diaphragm causes compression and rarefaction of air within the rigid enclosure 102.

The active driver speaker 112 and its sound-projecting surface (diaphragm or cone) are sized and configured for projecting sound at a somewhat uniform level across a particular range of frequencies. For instance, in some implementations, the active driver speaker 112 may be tuned to a frequency response of between about 10 and about 20,000 hertz (Hz), and in other implementations between about 20 Hz or higher and about 20,000 Hz or higher, where about 20 to about 20,000 Hz is the accepted audible frequency range. In some implementations the combination of active driver speaker 112 and volume of the rigid enclosure 102 may result in the active driver speaker 112 having a relatively flat frequency response in a range of between about 150 Hz to about 18,000 Hz or higher; between about 175 Hz to about 18,000 Hz; between about 200 Hz to about 18,000 Hz; between about 225 Hz to about 18,000 Hz; between about 250 Hz to about 18,000 Hz; between about 275 Hz to about 18,000 Hz; between about 300 Hz and about 18,000 Hz; between about 325 Hz and about 18,000 Hz.

Consistent with some implementations, the active driver speaker 112 may have a most consistently uniform frequency response at the higher frequencies in the frequency response range, acting as a mid- to high-range driver, or even as a tweeter. For example, the active driver speaker may have a relatively flat frequency response in a range of: between about 300 Hz and about 5000 Hz, between about 300 Hz and about 5500 Hz; between about 300 Hz and about 6000 Hz; between about 300 Hz and about 6500 Hz; between about 300 Hz and about 7000 Hz; between about 300 Hz and about 7500 Hz; between about 300 Hz and about 8000 Hz; between about 300 Hz and about 8500 Hz; between about 300 Hz and about 9000 Hz; between about 300 Hz and about 9500 Hz; between about 300 Hz and about 10,000 Hz; between about 300 Hz and about 10,500 Hz; between about 300 Hz and about 11,000 Hz; between about 300 Hz and about 11,500 Hz; between about 300 Hz and about 12,000 Hz; between about 300 Hz and about 12,500 Hz; between about 300 Hz and about 13,000 Hz; between about 300 Hz and about 13,500 Hz; between about 300 Hz and about 14,000 Hz; between about 300 Hz and about 14,500 Hz; between about 300 Hz and about 15,000 Hz; between about 300 Hz and about 15,500 Hz; between about 300 Hz and about 16,000 Hz; between about 300 Hz and about 16,500 Hz; between about 300 Hz and about 17,000 Hz; between about 300 Hz and about 17,500 Hz. Implementation of a passive radiator and active driver as a single assembly can simplify construction of the waterproof speaker, as well as reduce the number of apertures in the enclosure that require sealing against liquid intrusion. In addition, passive radiators associated with speakers of sufficiently small size will emit low frequencies (e.g., 100 Hz to 400 Hz) that are still above the frequency range typically considered to lack perceived directionality by a human listener (e.g., 80-100 Hz). Having a passive radiator projecting lower frequencies in the same direction as the active driver can be beneficial for listeners in that the lower frequencies will be perceived by the listener as coming from the same direction as the higher frequencies, allowing the listener to perceive the sound emanating from the passive radiator and active driver as having directional cohesion.

Due to physical limitations of sound projecting surface area, limited voice coil excursion, etc. as described herein, small-size active driver speakers (e.g., less than 5 inches in diameter) are typically inefficient at reproducing low-frequency sounds at loudness and distortion levels proportional to the levels at which higher-frequency sounds are generated, and thus benefit from use of a passive radiator to enhance the lower frequency response.

The passive radiator 108 may have a planar outer surface that circumscribes the active driver speaker 112 within the sound projecting region 104. The passive radiator 108 may have a mass that is tuned to cooperate with the outer and inner surrounds 106 and 110 to be driven to vibrate by sound waves, or changes in air pressure, within the rigid enclosure 102 resulting from compression and rarefaction of air within the rigid enclosure 102 by movement of the active driver speaker 112. For instance, the mass of the passive radiator 108 together with flexibility/compliance of the surround(s) may resist against movement by shorter, or higher, frequencies, yet be tailored or tuned to move at and enhance longer, or lower, frequencies. The lower frequency sound waves move significantly more air within the rigid enclosure 102 than higher frequency sound waves, thus driving the passive radiator 108 to project bass sounds from the sound projecting region 104. This allows a small enclosure to produce low frequency sounds in addition to those produced by the active driver.

In implementations consistent with this disclosure, the active driver speaker 112 may be mounted and fixed to a surface of the rigid enclosure 102, or to a fixed member inside of the rigid enclosure 102. For example, the active driver speaker 112 may be coupled by a bracket, basket, or tube to an inner surface of the rigid enclosure 102 as described herein. In some implementations the bracket or basket may connect at a permanent magnet (element 220 in FIG. 2) at a back portion of the active driver speaker 112 and to an outer perimeter of the outer surround 106, where a front portion of the bracket/basket attaches to the inner or outer surface of the rigid enclosure 102 such that the sound projecting region 104 including the combination of outer surround 106, passive radiator 108, inner surround 110 and active driver 112 seals an opening of the rigid enclosure 102. In certain aspects, the speaker system may be a weatherproof speaker system that inhibits the ingress of liquid and/or particulate matter (dust) into the assembly and the subassembly. For instance, the speaker system may include one or more seals, gaskets, and/or membranes that are specifically designed to allow sound to be transmitted there through but preventing liquid, such as water, to pass therethrough. A gasket, seal or other sealing element (e.g., an adhesive or welded joint) between the sound projecting region 104 and the corresponding wall of the rigid enclosure 102 may be used in order to provide a waterproof/weatherproof coupling of sound projecting region 104 and rigid enclosure 102.

In other implementations the active driver speaker 112 may be supported by a structural member, e.g., a tube, which may be fixed between a portion of the active driver speaker 112 and one or more of a plurality of walls of the enclosure, such as between an opposite wall of the rigid enclosure 102 and a rear portion of the active driver speaker 112. For example, a tube may extend rearward from the active driver speaker 112 to an opposite wall of the rigid enclosure 112. In one example, the tube may surround, or project from a more central portion of, the permanent magnet of the active driver speaker 112. In this implementation, a basket and/or bracket of the active driver speaker may connect to a central diameter of the inner surround 110 such that the driver diaphragm may be connected to an inner perimeter of the inner surround 110, while the passive radiator, or a diaphragm of the passive radiator, is connected to an outer perimeter of the inner surround 110. With the basket/bracket being connected to the central diameter, the passive radiator diaphragm and the driver diaphragm are isolated from each other to prevent or minimize direct influence one to the other. It will be appreciated that the inner surround 110 may, in this instance, comprise two distinct surrounds: a driver-side inner surround and a radiator-side inner surround. Each can be made to have the same or different flexibility characteristics and may be formed of same or different materials, examples of which are discussed below.

In another example, the tube may project back from an outer perimeter of the active driver speaker 112 to an opposite wall of the rigid enclosure, and may include openings that expose a rear surface of the driver diaphragm to the remaining interior of the rigid enclosure 102. In this example, additional structural members may secure the bottom and/or back of the active driver speaker to the tube so that the driver diaphragm may travel independently relative to the rigid enclosure 102 and the additional structural members. In an implementation such as this, an end of the tube may connect around a central portion of the inner surround so that the inner surround 110 may provide flexible/compliant suspension to the active driver speaker 112 on an inner perimeter of inner surround 110 and provide compliant suspension to the passive radiator 108 on an outer perimeter of the inner surround 110. Those having ordinary skill in the art will appreciate that structures other than a tube (e.g., cones, baskets, etc.) may provide structural support to the active driver speaker 112.

In other implementations, the active driver speaker 112 may be supported mainly by the inner surround 110, passive radiator 108 and outer surround 106. In these other implementations, a desired frequency response of the passive radiator 108 may be based, at least in part, on a predetermined mass of the active driver speaker 112, as well as the mass of the passive radiator 108 itself (and flexibility characteristics of the outer and inner surrounds 106, 110). Accordingly, the active driver speaker 112 in such embodiments contributes to the mass that tunes the passive radiator 108. This may serve to reduce the overall weight of the weatherproof loudspeaker and/or may permit the passive radiator diaphragm itself to be formed of a lighter-weight material. In some implementations, the mass of the driver diaphragm and/or the passive radiator diaphragm may be altered to approach optimal frequency response by adding mass to the respective diaphragm(s). For instance, the passive radiator diaphragm might be made more massive by affixing an item of appropriate mass to the diaphragm. In some instances, the item may include elements conventionally placed elsewhere in the rigid enclosure 102, such as a battery, electronics, wiring, and the like that may be fixed to a rear portion of the passive radiator diaphragm. Typically weight is added to a central portion of a passive radiator diaphragm. In disclosed embodiments, however, where central portions of a passive radiator diaphragm may be occupied by an active driver speaker, items used to add mass to the diaphragm itself may be fixed to the diaphragm so as to most evenly distribute the effect of the mass on the diaphragm.

In another aspect of this disclosure, the mass of the active driver diaphragm(s) and/or passive radiator diaphragm(s) may be controlled dynamically. For some genres of media content, a heavy bass response may be desirable, while other genres may be suited for more natural bass response. While frequency equalization by signal processing may impart significant frequency response changes, a physical change in the sound-producing elements of the loudspeaker may provide frequency response changes that have characteristics different from and/or complementary to those resulting from signal processing. Accordingly, in some embodiments of the loudspeaker, the mass of one or more diaphragms may be dynamically altered, based on user preference or media genre, etc., via a fluid chamber inside or affixed to the one or more diaphragms. A pump mechanism may inject fluid into the fluid chamber to impart additional mass to the diaphragm, or may remove fluid from the fluid chamber to impart a lesser mass to the diaphragm. A series of sub-chambers in the fluid chamber may be filled in series, to prevent sloshing in the fluid chamber and thus permit less distortion. It will be understood that the weatherproof loudspeaker may include, along with the pump and fluid chamber(s), a holding chamber and appropriate tubing for holding and transporting fluid, as well as control circuitry and valves for controlling the movement of such fluid.

In other embodiments, frequency response may be dynamically altered by changing the flexibility of the inner and/or outer surrounds (106, 110) while the active driver speaker 112 is actively producing sound. This may be accomplished, for example, by use of surround materials having dynamically changeable flexibility or by using suspension elements that have other changeable suspension characteristics. For example, in one embodiment, a hydraulic suspension may be used which implements electrorheological fluid. In response to an electric field, the viscosity of electrorheological fluid can be changed by several orders of magnitude in a very short time (milliseconds) to provide stiff or compliant suspension and thereby changing the frequency response of the active driver speaker and/or passive radiator attached to the suspension.

The rigid enclosure 102, outer surround 106, passive radiator 108, inner surround 110 and/or active driver speaker 112 may each be formed of waterproof materials, and the connective interface between any two elements may be sealed and virtually waterproof, dust-proof, and otherwise weatherproof at pressures expected for average use. For example, the materials and sealing techniques may impart the weatherproof loudspeaker with an ingress protection rating of IP68 or better. In some implementations, the rigid enclosure 102 can be formed of a rigid material such as plastic, polycarbonate, polypropylene, carbon fiber, polyvinyl chloride, a metal such as steel or aluminum, or any other rigid material. The rigid enclosure 102 can also be overmolded in part or completely with a pliable material such as butyl rubber, thermoplastic elastomers, polypropylene, polycarbonate, and the like. The outer surround 106 and/or inner surround 110 can be formed of a flexible, pliable and impermeable material such as butyl rubber. The cone of the active driver speaker 112 can be formed of a waterproof material such as polypropylene, a closed-cell foam, or other material.

Weatherproof surround portions (outer surround 106 and/or inner surround, 110) may be formed from materials that are waterproof and are bonded in a waterproof manner to active drivers and/or passive radiators. For example, the surrounds may be formed of thermoplastic elastomers, such as butyl rubber, natural rubber, or a rubber composite, such as SANTOPRENE. In some embodiments, a surround may be formed from a pleated textile that is coated with a hydrophobic material, such as ePTFE. Exemplary textiles may include GORE-TEX, ULTREX, and some SEFAR acoustic HF materials, as well as textiles that utilize carbon fibers, para-aramid fibers (e.g. KEVLAR), meta-aramid fibers (e.g. NOMEX), and liquid crystal polymer fibers (e.g. VECTRAN). The surround portions may be adhered via waterproof adhesives or welded (e.g. ultrasonically) to one or more apertures in the passive radiator.

A wide variety of materials may be used to construct diaphragms for both the active driver and the passive radiator. Exemplary materials for construction of diaphragms for active drivers and passive radiators can include: polymers such as polypropylene or bi-axially oriented polyethylene terephthalate (e.g. MYLAR); metals and alloys, such as aluminum and magnesium; ceramics, such as diamond or aluminum oxide; and laminates and composites that are waterproof or treated with a waterproof coating (e.g. ePTFE, epoxy, or polyurethane). Laminates and composites of metal, paper, and ceramic materials may include fibers or honeycomb structures using materials such as para-aramid (KEVLAR) and/or meta-aramid (NOMEX), and liquid crystal (VECTRAN) polymers. Carbon and glass fibers and structures may also be used to create strength and resiliency in the diaphragms (e.g. fiberglass). Speaker diaphragm materials suitable for mid and high range frequencies may include beryllium, titanium, and phenolic. Speaker magnets may include neodymium, samarium-cobalt, barium ferrite, strontium ferrite, or alnico magnets.

Any seams of the rigid enclosure 102, such as ports, doors, or access holes or apertures, or interfaces of two or more parts that form the rigid enclosure 102, can also be sealed. For example, a battery compartment can be closed and sealed by a sealed door. In another example, a charge port, headphone input jack, and/or auxiliary speaker output jack (not shown) can each include a specially-fitted plug, bung or other sealing member. Any of the seams or sides of the rigid enclosure can be formed by one or more connecting members, and can include a gasket or other sealing member.

In some embodiments, the rigid enclosure includes at least two portions that mate together in order to form a single, waterproof rigid enclosure assembly. In some embodiments, the two or more pieces include a front portion of the enclosure having the active driver and passive radiator surround and a rear portion of the enclosure. In some embodiments, the two or more pieces (e.g., a top and bottom portion) mate longitudinally to form a single, waterproof rigid enclosure assembly. In some embodiments, either the first or second longitudinal portions include a rigid frame, bracket, spoke, or spar assembly that includes the active driver. For example, if the first longitudinal portion includes a rigid frame and active driver, the second longitudinal portion includes a cutaway that allows the rigid frame and active driver from the first longitudinal portion to mate and seal with the second longitudinal portion.

In some embodiments, the two or more portions of the enclosure include one or more clasping mechanisms, for example an entirely internal clasping mechanism, an entirely external clasping mechanism, or a hybrid internal/external clasping mechanism configured to seal the enclosure to entry from water, liquids, and particulates. In certain embodiments, the clasping mechanism is an entirely internal clasping mechanism. By "entirely internal clasping mechanism", it is meant that the clasping mechanism is entirely contained within the bounds that form the interior or cavity of the enclosure when the two or more portions of the enclosure (e.g. front and rear portions; first and second longitudinal portions) are coupled together so as to form the housing. In certain embodiments, the clasping mechanism is an entirely external clasping mechanism. By "entirely external clasping mechanism", it is meant that the clasping mechanism is positioned entirely on exterior portions of the two or more portions of the enclosure such that when the two or more portions of the enclosure are coupled together the clasping mechanism is positioned exteriorly to the bounds that form the cavity of the enclosure. In certain embodiments, the clasping mechanism is a hybrid clasping mechanism that is partially internal and partially external to the bounds that form the cavity of the enclosure. Accordingly, in certain instances, the perimeter portion may include one or more clasping mechanisms, such as internal, external, and/or hybrid clasping mechanisms that are configured so as to secure the sealing of the two or more portions together. The clasping mechanisms may be separate elements added on to the perimeter portion of the housing, e.g., where the clasping mechanism is an external clasping mechanism, or may be an integral member therewith, e.g., where the clasping mechanism is an internal or hybrid clasping mechanism.

In certain embodiments, the clasping mechanism may include a plurality of clasping mechanisms such as one or more internal and/or one or more external and/or one or more hybrid clasping mechanisms. For instance, in various embodiments, the housing may include a plurality of internal clasping mechanisms and/or may include one or more external and/or hybrid clasping mechanisms. For example, the housing may include a first entirely internal clasping mechanism, e.g., one that circumscribes a portion or an entire perimeter of the housing; and may include a second entirely internal clasping mechanism, e.g., a second internal clasping mechanism that circumscribes an additional portion or entire perimeter of the housing. A further, external or hybrid clasping mechanism may also be provided.

Accordingly, in various embodiments, a single internal, external, or hybrid clasping mechanism may be provided; and in other various embodiments, a plurality of clasping mechanisms, e.g., internal, external, and/or hybrid clasping mechanisms, may be provided. For instance, in certain embodiments, a plurality of internal clasping mechanisms are provided. The clasping mechanisms are configured such that when the top and bottom members are coupled together a liquid-proof seal is provided thereby which seal protects the internal components of the enclosure (e.g. circuitry, wiring) thereof from liquid, such as water.

In one embodiment, one or both of the two or more enclosure portions may include a channel, such as a channel that extends along the perimeter portion of the first and/or second portion. The channel along the perimeter portion may include an interior bounding member (e.g. an inner wall) and an exterior bounding member (e.g. an outer wall), which bounding members at least partially define the bounds of the channel. Hence, in such an embodiment, the perimeter portion includes an interior perimeter portion, e.g., an interior bounding member; and an exterior perimeter portion, e.g., exterior bounding member. A bottom bounding member may also be provided. Accordingly, the perimeter portion may include an interior and an exterior perimeter portion, and in certain instances, the interior and exterior bounding members of the channel are the same as the interior and exterior perimeter portions of the top and/or bottom member. A portion of the bottom member may also provide a bottom bounding for the channel. The at least one channel may additionally include a gasket or seal positioned within the channel. The gasket may be: an O-ring that is removably placed or adhered in the channel, an elastomer that is glued, bonded, overmolded, or otherwise adhered to any portion of the channel (e.g., the bottom surface, one or more of the side walls, or both).

In certain embodiments, where one top or bottom member includes a perimeter portion containing a channel, e.g., bounded by interior and exterior bounding members, the opposing member may additionally include a perimeter portion that includes an interior perimeter portion, such as a perimeter portion that interacts with the channel, e.g., so as to compress a gasket contained therein, and an exterior perimeter portion, which exterior perimeter portion may or may not interact with the channel. For instance, where the bottom member includes a perimeter portion having a channel bounded by interior, exterior, and/or bottom bounding members, the top member may include a perimeter portion that also includes interior and exterior perimeter portions, albeit without an intervening channel therebetween, which perimeter portions may be configured for interacting with one or more of the perimeter portions of the bottom member. For example, the interior and/or exterior bounding member(s) of the channel of the perimeter portion of the bottom member may include a clasping mechanism, and a corresponding interior or exterior perimeter portion of the top member may include a corresponding clasping mechanism, such that when the top and bottom members are coupled together and the clasping mechanism clasped, e.g., snapped, together a liquid-proof seal is provided thereby. In certain embodiments, a ridge element of an inner perimeter portion (for either a top or bottom member) may press against a gasket or seal on a bottom portion of a channel. In certain embodiments, an outer surface of an inner perimeter portion may press against at least a portion of a gasket or seal included with an outer wall of a channel.

In some embodiments, the perimeter portion of one part of the enclosure forms an outer perimeter and the perimeter portion of the other part of the enclosure forms an inner perimeter, wherein the inner and outer perimeters mate together parallel to one another. In such embodiments, the ridge element of the inner perimeter does not rest inside a channel to form a seal. Instead, a seal is formed by a gasket or seal that rests in between the inner and outer perimeter portions (e.g. inner and outer walls). The gasket or seal may be adhered, bonded, overmolded, or otherwise attached along the wall of either the inner or outer perimeter portions, and may be located in groove in either the inner or outer perimeter portion. In some embodiments, a gasket and/or groove located on an inner or outer wall may be combined with a channel and/or gasket that receives a ridge element (as described supra).

The clasping mechanism may extend around the entire perimeter of the first and second enclosure members or a portion thereof. For instance, the clasping mechanisms may extend around about 99% or more, about 95%, about 90%, about 85%, about 80%, about 75%, about 70%, about 65%, about 60%, about 55%, about 50%, about 40%, about 30%, about 25%, about 20%, about 10%, or less of the perimeter, such as where the first and second enclosure members are joined by a suitable hinge element. For instance, where a first or second enclosure member includes an interior or exterior perimeter portion and/or a channel bounded by an interior or exterior bounding member, the interior and/or exterior perimeter portion may be configured such that a portion thereof forms the clasping mechanism.

As set forth above, a plurality of clasping mechanisms both internal and/or external may be included as part of the enclosure. For instance, the housing may include one or a plurality of internal clasping mechanisms and/or one or a plurality of external clasping mechanisms. As explained below, the clasping mechanisms may have a variety of different configurations. For example, the top and bottom members may each include an internal clasping mechanism that is configured as opposing catches or hooks and/or extended portions and grooves, which clasping mechanisms circumscribe an internal portion of the perimeter of the top and bottom members. Alternatively, or in addition to the opposing catch mechanisms, the top and bottom member may include an internal clasping mechanism that is configured as male and female counterparts, e.g., teeth and holes. Additionally or alternatively the housing may include an external clasping mechanism that may have any suitable configuration such as a clip or peg and slot configuration. Accordingly, in various embodiments, the interior and/or exterior perimeter portions as well as the interior and/or exterior bounding members of the first and second members of the enclosure may include clasping mechanisms, e.g., corresponding clasping mechanisms, that are configured for interacting with one another so as to couple the top and bottom members together, e.g., in a liquid-proof seal.

In certain embodiments, the joint between the two or more enclosure portions or members may be adhered (using waterproof adhesives e.g. epoxies, cyanoacrylates, acrylics, polyurethanes, and the like) or welded (e.g. ultrasonically welded) to provide an additional waterproof seal for the enclosure.

In one instance, a perimeter portion may include a door or cover that includes a latch feature, for instance, a latch feature for enclosing an opening, such as a port opening or battery cavity. The latch feature may include a first latch interface, a latch, and an second latch interface, such that the latch feature is configured for moving from a closed position, where the latch is in contact with both the lower and upper latch interfaces, to an open position, where the latch is in contact with only one of the lower or upper latch interfaces. In certain instances, that latch feature may be positioned entirely on a first or second enclosure portion, and in other instances, portions of the latch feature are included on both first and second enclosure portions. In various embodiments, the latch feature is liquid-proof and/or dust-proof and may include a gasket so as to provide a liquid and/or dust proof seal when the latch is in the closed position. The door or cover may be attached to the enclosure via a tether, hinge, or axle assembly.

In some embodiments, a portion of the enclosure (e.g. the perimeter portion) may include a switch feature for engaging a switch mechanism of an encased device. The switch feature may include a switch housing and an actuator having a switch interface. The switch feature may additionally include an axle configured for being coupled to the switch housing and/or the switch interface. The switch feature may be configured such that as the actuator moves, such as rotates about the axle (if included), from a first position to a second position within the switch housing, the switch interface causes the switch to move from a first to a second position, such as from an "on" to an "off" position. In certain embodiments, one or more protective bumper portions may be positioned around the one or more switches or buttons so as to protect them from impact.

In some embodiments of the instant technology, the enclosure includes buttons for controlling various functions of the speaker enclosure, e.g. turning power on and off, pairing the device with a radio signal, controlling volume and muting functions, and the like. The enclosure may include one or more apertures overmolded or undermolded with a flexible, waterproof material (e.g. silicon rubber, thermoplastic elastomer, or the like) that provide prevent ingress of water, liquids, and particulates while allowing physical access to buttons proximate the apertures. In some embodiments, buttons may be adhered to an undermolded flexible material, allowing access to electrical contacts or secondary buttons underneath the undermolded material.

In an additional embodiment, a portion of the speaker enclosure (e.g., the outer perimeter portion) may include a port feature such as a headphone port feature, for instance, for receiving either a jack (such as a jack of a headphone or speaker assembly) or a closure device or the like. The port feature may include an aperture positioned in one or both of the first and/or second members. The aperture extends from the exterior of the assembly to the interior of the assembly. The aperture may be bounded by one or both of a gasket, such as an O-ring, and a threaded or cammed region, which threaded or cammed region may be configured for receiving a corresponding threaded or cammed region present on either the jack or the closure device to be inserted therein. The threaded region may be configured as a typical thread feature or may be configured as a cam feature. The port feature may include a port sealing bung attached with a tether. In some embodiments, the port sealing bung may further include a gasket circumscribing the port sealing bung. The port sealing bung may be pressed or screwed into the port aperture, such that the bung compresses on a gasket seat proximate the aperture, creating a watertight seal.

In some embodiments of weatherproof loudspeakers (particularly airtight speakers), a waterproof but gas permeable vent may be included to enable static pressure equalization. Air pressure inside a sealed enclosure may change due, for example, to a change in elevation, environmental heat, internally-generated heat, or the like. A static (at-rest) pressure differential between the interior and exterior of the enclosure can cause sound-generating surfaces (driver and passive radiator) to rest in a position other than the "neutral" rest position. The neutral rest position occurs when the pressures exterior and interior to the speaker enclosure are substantially equal. Such an interior-exterior static pressure differential can change the sound quality of the speaker device and may in some circumstances result in damage to speaker components. The static pressure differential may be addressed by use of a small aperture or vent. The vent may be constructed in such a way as to prevent entry of liquids into the enclosure, yet allow slow pressure equalization between the interior and exterior of the enclosure, such as when the speaker is transported between environments with higher and lower atmospheric pressure. In at least one embodiment, the small aperture alone may prevent liquid from entry, yet permit air to slowly pass through a surface of the speaker device. In other embodiments a waterproof textile or mesh may be applied to the small diameter aperture that extends through an enclosure wall. Alternatively, the slow pressure vent may be located in an aperture located on a surround proximate to an active driver or passive radiator. Exemplary waterproof textile/mesh materials include hydrophobic material such as polytetrafluoroethylene (ePTFE), as well as woven and non-woven textiles coated with hydrophobic material, such as expanded GORE-TEX, ULTREX, and some SEFAR ACOUSTIC HF materials.

In still other embodiments, a manually or mechanically removable waterproof plug may cover the small aperture, and a pressure sensor may be implemented to detect static differential pressure, and a user may be notified that of a need to equalize the pressure. The waterproof plug may be compressible gasket or include a compressible gasket. In still another embodiment, an electromechanical device may operate to temporarily uncover a pressure relief aperture in response to pressure differential detection. In any of the disclosed pressure relief aperture embodiments described above, the surface area of the pressure relief aperture may be about 0.01% or less of the surface area of the entire speaker cabinet, so as to minimize air loss inside the cabinet during speaker use. In other embodiments, the surface are of the aperture may be between about 0.001% and about 0.1% of the enclosure surface area. For example, a rectangular box enclosure having surface area of about 145 square inches may include an aperture of about 1/10 inch in diameter (about 0.008 square inches area), or about 0.005% of the surface area. In some embodiments, including those having a manual or electromechanical aperture plug, the surface area of the vent aperture may be larger, between about 0.1% and about 0.3% of the surface area of the entire speaker cabinet or larger.

In implementations consistent with the disclosure, the surface area of the passive radiator 108 has a relationship with the projecting area of the diaphragm of the active driver speaker 112 of at least about 2:1. Accordingly, the surface area of the passive radiator 108 is preferably at least twice the projecting area of the cone/diaphragm of the active driver speaker 112. In some embodiments, the ratio of the surface area of the passive radiator to the projecting area of the active driver diaphragm is about 2.1:1; is about 2.2:1; is about 2.3:1; is about 2.4:1; is about 2.5:1; is about 2.6:1; is about 2.7:1; is about 2.8:1; is about 2.9:1; is about 3:1; is from about 3:1 to about 3.5:1; is from about 3.5:1 to about 4:1; is from about 4:1 to about 4.5:1; is from about 4.5:1 to about 5.0:1; is from about 5.0:1 to about 6.0:1; is from about 6.0:1 to about 7.0:1; is from about 7.0:1 to about 8:0:1; is from about 8.0:1 to about 9.0:1; is from about 9.0:1 to about 10.0:1. To optimize the area of the sound projecting region 104 yet economize on the dimensions and size of the loudspeaker 100, the passive radiator 108 may be formed around the active driver speaker 112, in a substantially square or rectangular shape with curved outer corners. The curved corners reduce potential distortion, as well as thwart potential structural weaknesses that might subject the passive radiator 108 or outer surround 106 to damage resulting from diaphragm movement should they have sharp corners. Further, the square or rectangular shape of the passive radiator 108, particularly at its outer periphery, can maximize the surface area of the passive radiator 108 relative to the area of the sound projecting region 104. Other perimeter shapes of the passive radiator may include circular, triangular, pentagonal, hexagonal, heptagonal, octagonal, nonagonal, decagonal, as well as other symmetrical and asymmetrical polygons. In some embodiments, the shape may be partially rounded with at least one flat side. The enclosure may have the same geometry as the passive radiator and extended to provide an enclosure with volume. Alternatively, the passive radiator may have a geometry that is not the same as that of the enclosure.

In some alternative implementations, to improve the appearance and/or aesthetics of the speaker 100, the passive radiator 108 can be formed of a translucent material, such as PLEXIGLAS or GORILLA glass. In these implementations, the speaker 100 can include one or more light sources within the rigid enclosure 102, and which project light out to the external environment through the translucent material of the passive radiator 108. In yet other implementations, the active driver speaker 112 can be translucent, alone or with the passive radiator 108. As described above, some embodiments may implement a fluid chamber to adjust diaphragm mass. The fluid may alternatively or additionally have light-transmission or light emission (e.g., electrofluorescent) properties. The fluid chamber may be configured to hold liquid crystal elements and be fitted with a pattern of electrodes that permit the liquid crystal to be controlled in definable patterns to block or transmit light generated from behind the fluid chamber. Elements of the fluid chamber may additionally include color filter areas (e.g., RGB pixels) each of which may be controlled to pass or block light.

Figure 2A:
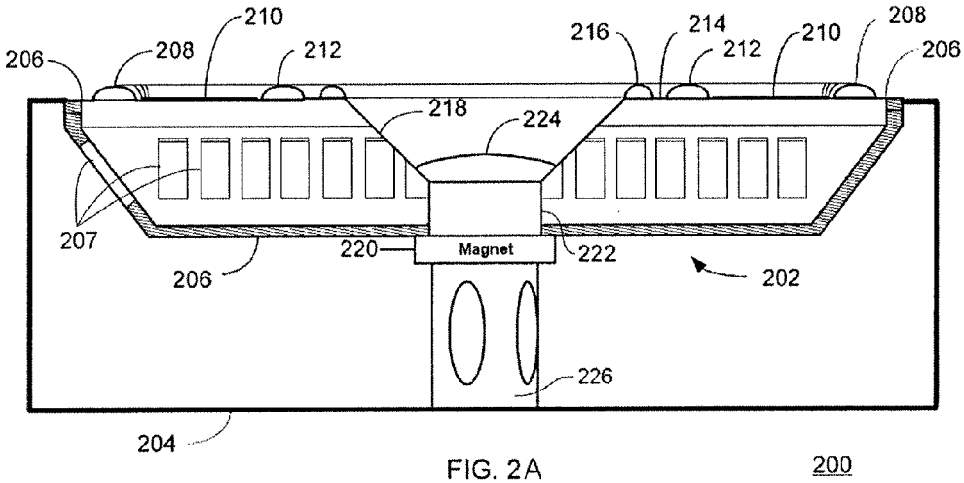
FIGS. 2A-2C illustrate side views of some implementations of a speaker.
Figure 2B:
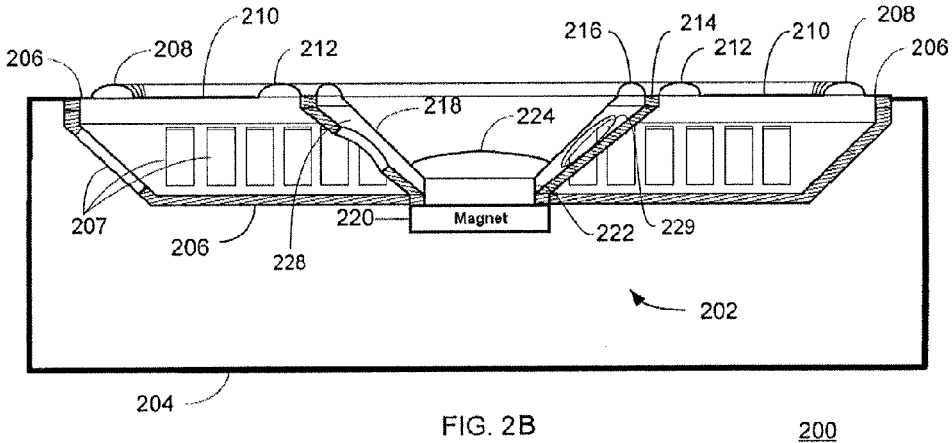

FIGS. 2A and 2B illustrate side views of some implementations of a speaker 200. The speaker 200 can include a speaker assembly 202 that can be formed and mated with a rigid enclosure 204. The speaker assembly 202 includes a frame 206 to which a number of sound generating components are attached, and the frame 206 can be fit into an opening of the rigid enclosure to close and seal the opening. The rigid enclosure 204 has an inner surface and an outer surface. The inner surface is defined by one or more walls that form the rigid enclosure 204, and can be further defined by battery housings, electronics housings, or other things contained by the rigid enclosure. The frame 206 can be formed of plastic, metal or other rigid material, and can have a number of apertures or holes 207, particularly on a side facing an inner surface of the rigid enclosure 204. Although apertures 207 are illustrated as regular rectangular openings, it will be appreciated that the apertures may take other forms without deviating from the intent of the present disclosure. The frame 206 holds together the component parts of the speaker assembly 202.

The speaker assembly 202 further includes an outer surround 208 connected with an outer face of the frame 206, which defines the sound projecting region of the speaker assembly 202. The speaker assembly 202 further includes a passive radiator 210 having an outer periphery connected with the outer surround 208, an inner surround 212 connected with an inner periphery of the passive radiator 210. The inner surround 212 is connected in turn with a driver frame 214 that circumscribes an active driver surround 216 and cone 218. The driver frame 214 may (as shown in FIG. 2B) include a basket 228 having openings or holes 229 to permit the free flow of air between the cone 218 and the interior of the rigid enclosure 204. Holes 229 may take any form so long as air may pass relatively unimpeded through the basket 228 and still permit the basket to provide sufficient structural support. In another implementation (not illustrated) the driver frame 214 may include a cylinder positioned between the frame 206 and the area between inner surround 212 and active driver surround 216. The active driver speaker includes a voice coil (not shown) of voice coil assembly 222, that is activated by control circuitry (not shown) to cause the voice coil to interact with the permanent magnet 220. The voice coil may be attached to the cone 218 such that the interaction with the magnet causes the voice coil, and thus cone 218 to move and reproduce sound. The active driver speaker further includes a dust cap 224, which can be shaped and configured to contribute to the acoustics of the active driver speaker and cone 218. The cone 218 will also produce sound waves back in toward the inner frame 206 and the rigid enclosure 204, a portion of which sound waves cause sufficient compression and rarefaction in the rigid enclosure 204 to move the passive radiator 210, as discussed above. Those of ordinary skill in the art will recognize that driver cone 218 may be implemented in other geometries such as a planar diaphragm or a dome.

Figure 2C:
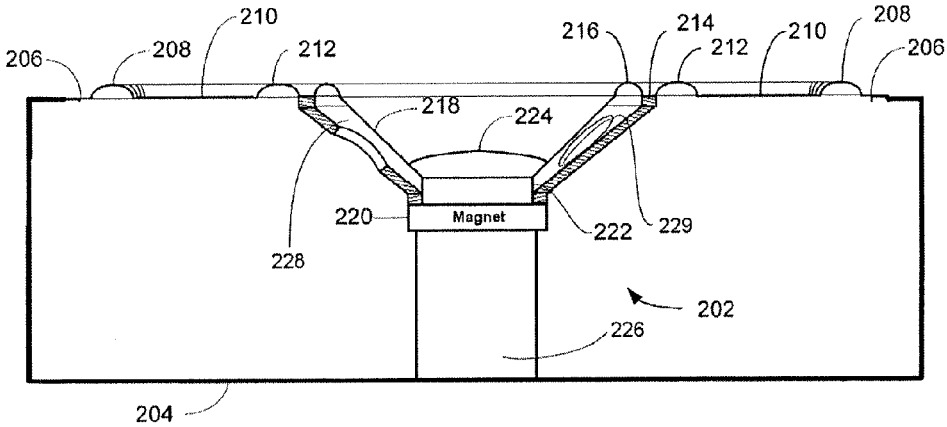

In some implementations, illustrated for example at FIGS. 2A and 2C, the active speaker components may be fixed to the rigid enclosure via a rear support 226 positioned between the speaker components (e.g., the magnet 220) and a rear wall of the rigid enclosure 204. In this manner, the actively driven cone 218 may travel in and out efficiently relative to the frame 206 and the rigid enclosure 204. Rear support 226 may, in non-limiting examples, be implemented as a cylinder, a rod, and/or when the distance between the rear of the active speaker components is very near the rear wall of the enclosure, may be implemented as an adhesive or adhesive film. In each case, an adhesive or adhesive film may include sound and/or vibration insulating properties to prevent movement of the active speaker diaphragm from directly causing vibration of the enclosure.

As noted above, FIG. 2B illustrates an embodiment in which the speaker components include a basket 228 for structural support of the active driver speaker, the basket including openings or holes 229. This implementation may in some embodiments further include a rear support, such as the rear support 226 illustrated in FIG. 2A. In some implementations that include both the rear support 226 and the basket 228, the frame 206 and holes 207 may be eliminated and the outer surround 208 may be connected directly to the rigid enclosure 204 at a perimeter of the passive radiator 210. This embodiment is illustrated at FIG. 2C.

Figure 3:
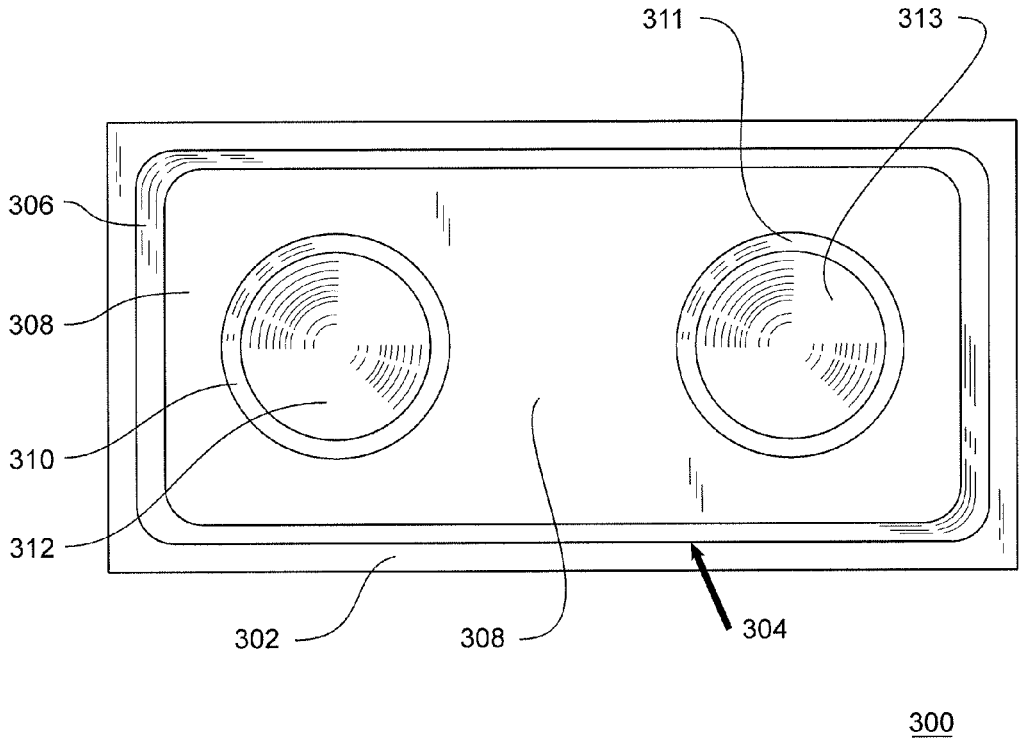
FIG. 3 illustrates an alternative implementation of a weatherproof loudspeaker having two or more active driver speakers within a passive radiator.

FIG. 3 illustrates an alternative implementation of a weatherproof loudspeaker 300 having two or more active driver speakers within a passive radiator. In most respects, this alternative implementation may be the same as the weatherproof loudspeaker described above and illustrated in FIGS. 1 and 2. The loudspeaker 300 is sealed against the outside environment, and resistant to water, dust, or other particulates. The loudspeaker 300 includes a rigid enclosure 302 that is sealed from an environment external to the loudspeaker 300. The rigid enclosure 302 defines and includes a sound projecting region 304. The sound projecting region 304 is at least partially or completely framed by a first, or outer, surround 306, which is formed of a flexible, waterproof material. The loudspeaker 300 further includes a passive radiator 308 having an outer periphery that is connected with the outer surround 306.

The sound projecting region 304 of the speaker 300 further includes a first inner surround 310 and a second inner surround 311, each connected with an inner periphery of a cutout or aperture in the surface of the passive radiator 308. The first and second inner surrounds 310, 311 are also formed of a flexible, waterproof material. The sound projecting region 304 of the speaker 300 further includes a first active driver speaker 312 and a second active driver speaker 313, each connected at an outer periphery with the respective first and second inner surrounds 310, 311. Each active driver speaker 312, 313 may receive a signal from control circuitry (not shown) to activate and drive at least one voice coil with respect to a magnet (not shown), thereby driving and vibrating a cone that projects sound waves from a front side of the active driver speakers 312, 313 and from the sound projecting region 304. The active driver speakers 312, 313 are vented on a back side to also project sound waves from a back side of the cone to within the rigid enclosure 302. Each active driver speaker can include a mounting structure that is formed to permit air within the rigid enclosure to be compressed and rarefied according to movement of the back surface of the cone.

The active driver speakers 312 and 313 and their cones are sized and configured for projecting sound at a particular range of frequencies. For instance, in some implementations, the active driver speakers 312 and 313 are tuned to a frequency response of between about 10 and about 20,000 hertz (Hz), and in other implementations between about 20 and about 20,000 Hz or higher. In some implementations, the active driver speakers 312 and 313 are tuned toward the higher frequencies in the frequency response range, acting more as a mid- to high-range driver, or even as a tweeter. For example a particular size of rigid enclosure 302 together with active driver speakers 312 and 313 may result in the active driver speakers themselves having an relatively consistent frequency response in a range of about 150 Hz or higher to about 18,000 Hz or higher.

The active driver speakers 312 and 313 are sized and spaced to provide stereo separation for at least some range of frequencies, i.e., at a higher range of frequencies. In some implementations, the speaker 300 can include more than two active driver speakers, and can include three or more active driver speakers, each active driver speaker being surrounded by a passive radiator, either individually or collectively in numbers of two or more active driver speakers. For instance, a passive radiator may have a planar sound projecting surface with three or more cut-outs or apertures, which are lined with an inner surround that flexibly allows vibration yet separation from the active driver speaker mounted within each inner surround. Each active driver speaker may be fixed and stationary relative to the rigid enclosure, or may be formed with the passive radiator to contribute to the mass of the passive radiator.

The passive radiator 308 preferably has a planar outer surface that circumscribes or surrounds the two or more active driver speakers 312, 313 within the sound projecting region 304. The passive radiator 308 has a mass that, together with the flexibility/compliance of corresponding surrounds, is tuned to be driven to vibrate by a predetermined portion of the sound waves directed to the interior of the rigid enclosure 302 by the active driver speakers 312 and 313. For instance, the mass of the passive radiator 308 and compliance of the surrounds may resist against movement by shorter, or higher, frequencies, yet be tailored to move and enhance longer, or lower, frequencies. The lower frequency sound waves move significantly more air within the rigid enclosure 302 than higher frequency sound waves, thus driving the passive radiator 308 to project bass sounds from the sound projecting region 304.

In preferred implementations, the active driver speakers 312, 313 are mounted and fixed to an internal surface of the rigid enclosure 302, or to a fixed member inside of the rigid enclosure 302. For example, the active driver speakers 312, 313 may be coupled by a bracket or ported tube to an inner surface of the rigid enclosure 302. In other implementations, the active driver speakers 312 and/or 313 are supported mainly by the inner surrounds 310 or 311, passive radiator 308 and outer surround 306. In these other implementations, a desired frequency response of the passive radiator 308 is based, at least in part, on a predetermined mass of the active driver speaker 312 or 313, as well as the mass of the passive radiator 308 itself (and flexibility characteristics of the outer and inner surrounds 306, 310 or 311). Accordingly, the active driver speaker 312 may contribute to the mass that tunes the passive radiator 308.

The rigid enclosure 302, outer surround 306, passive radiator 308, first and second inner surround 310, 311 and active driver speaker 312 are each formed of waterproof materials, and the connective interface between any two elements is sealed and waterproof, dust-proof, and otherwise weatherproof. In some implementations, the rigid enclosure 302 can be formed of a rigid material such as plastic, polycarbonate, carbon fiber, polyvinyl chloride, a metal such as steel or aluminum, or any other rigid material. The rigid enclosure 302 can also be overmolded in part or completely with a pliable material such as butyl rubber. The outer surround 306 and/or inner surrounds 310 and 311 can be formed of a flexible, pliable and impermeable material such as butyl rubber. The cone of the active driver speakers 312 and 313 can be formed of a waterproof material such as polypropylene, a closed-cell foam, or other material. In yet other implementations, each active driver speaker 312 and 313 can be formed of a different material for different acoustic characteristics and for projecting different sound frequencies or ranges of frequencies. Accordingly, one active driver speaker can act as a mid-range speaker, while the other can function as a high-range speaker, or tweeter.

Any seams of the rigid enclosure 302, such as ports, doors, or access holes or apertures, or interfaces of two or more parts that form the rigid enclosure 302, can also be sealed. For example, a battery compartment can be closed and sealed by a sealed door. In another example, a charge port, headphone input jack, and/or auxiliary speaker output jack (not shown) can each include a specially-fitted plug, bung or other sealing member. Any of the seams of the rigid enclosure can be formed by one or more connecting members, and can include a gasket or other sealing member.

In implementations consistent with this disclosure, the surface area of the passive radiator 308 may have a relationship with the collective sound projecting area of active driver speakers 312 and 313 of about 2:1 or more. Accordingly, the surface area of the passive radiator 308 is preferably at least twice the sound projecting area of the cone of the active driver speakers 312 and 313. To optimize the sound projecting region 304 yet economize on the dimensions and size of the speaker 300, the passive radiator 308 may be formed around the active driver speakers 312, 313, in substantially a square or rectangular shape with curved corners. The curved corners reduce potential distortion and other sonic aberrations, as well as thwart potential physical weaknesses that might result in damage to the passive radiator 308 or outer surround 306 should they have sharp corners. Further, the square or rectangular shape of the passive radiator 308, particularly at its outer periphery, can maximize the surface area of the passive radiator 308 relative to the area of the sound projecting region 304.

Figure 4A:
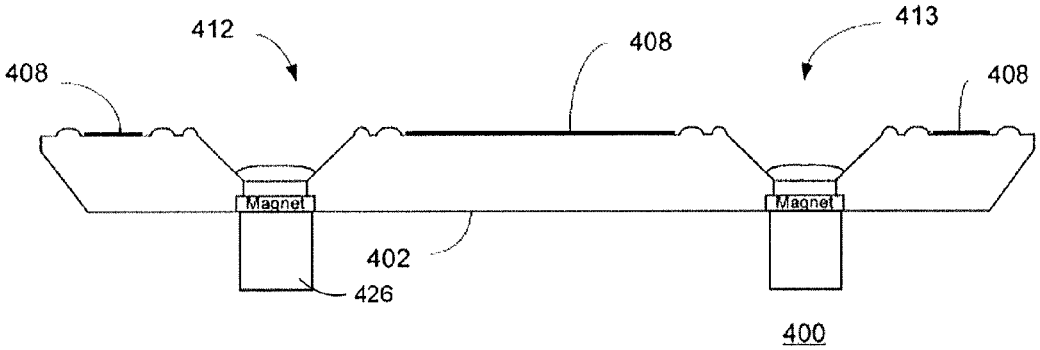
FIGS. 4A-4C illustrate side views of a speaker assembly for a weatherproof loudspeaker consistent with disclosed embodiments.
Figure 4B:
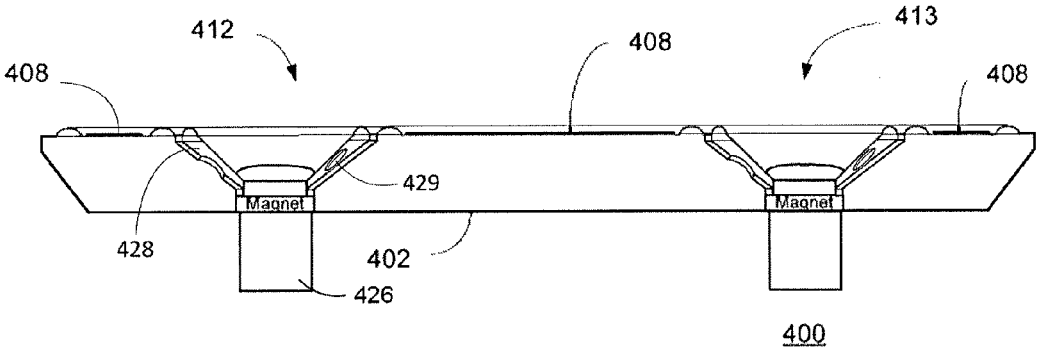
Figure 4C:
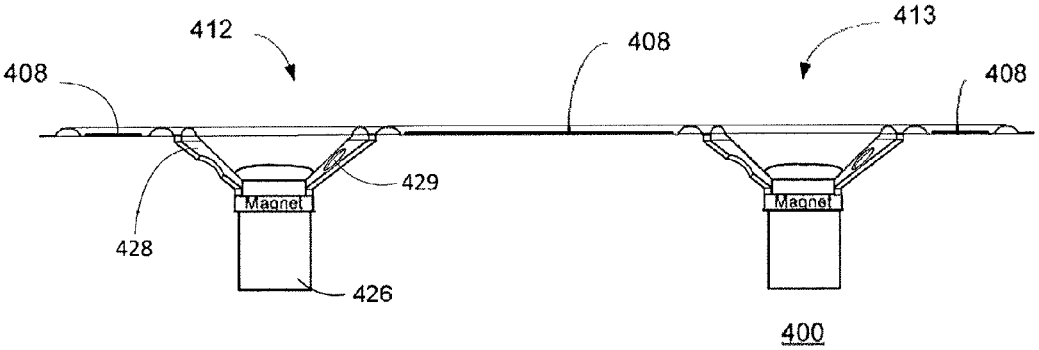

FIGS. 4A-4C illustrate a side view of a speaker assembly 400 for a weatherproof loudspeaker, similar to the speaker assemblies shown in FIGS. 2A-2C. The speaker assembly 400 includes a frame 402 that combines the components of the speaker together for ease of construction, manufacturing and assembly. The speaker assembly 400 includes two or more active driver speakers 412 and 413 attached to rigid support 426 (which is in turn attached to the rigid enclosure, not shown), and can include three or more active driver speakers. The active driver speakers 412 and 413 include diaphragms/cones and active driver surrounds, and are circumscribed by inner surrounds, which in turn are connected with inner peripheries of a number of cut-outs or apertures in a passive radiator 408, and in which the active driver speakers 412 and 413 are mounted. Each active driver speaker may include a basket 428 having openings or holes 429, similar to that illustrated in FIG. 2B. The passive radiator 408 has a planar outer surface that surrounds or frames the two or more active driver speakers 412 and 413.

The speaker assembly 400 further includes an outer surround connected with an outer face of the frame 402, which defines the sound projecting region of the speaker assembly 400. Each active driver speaker includes a magnet that is activated by control circuitry (not shown) to operate a core and voice coil assembly, which in turn drives a driver diaphragm/cone to reproduce sound. Each active driver speaker further includes a dust cap, which can be shaped and configured to contribute to the acoustics of the active driver speaker and cone. The cone will also produce sound waves back in toward the frame 402 and a rigid enclosure to which the frame 402 is attached, a portion of which sound waves move the passive radiator 408, as discussed above.

Figure 5:
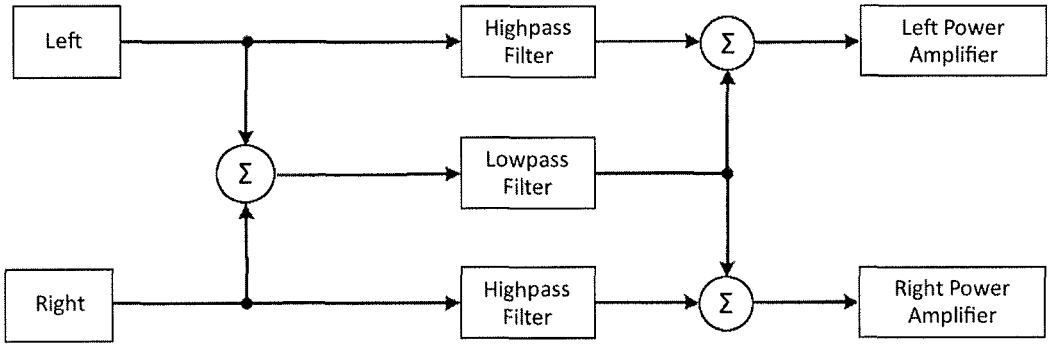
FIG. 5 illustrates signal processing of a dual driver and passive radiator weatherproof loudspeaker assembly.

FIG. 5 illustrates signal processing for some embodiments of a dual driver and passive radiator weatherproof loudspeaker assembly. Left and right channels are summed together to create a mono channel. The highpass filter and lowpass filter have flat summation. This allows the low (typically non-directional) frequencies to the drivers to be mono (and thus reproduced by all of the active driver speakers) and still have stereo separation into left and right channels for the higher frequencies. The mono low frequencies allows for the two active drive units to always be in phase, so that the passive radiator has linear pistonic motion.

Figure 6:
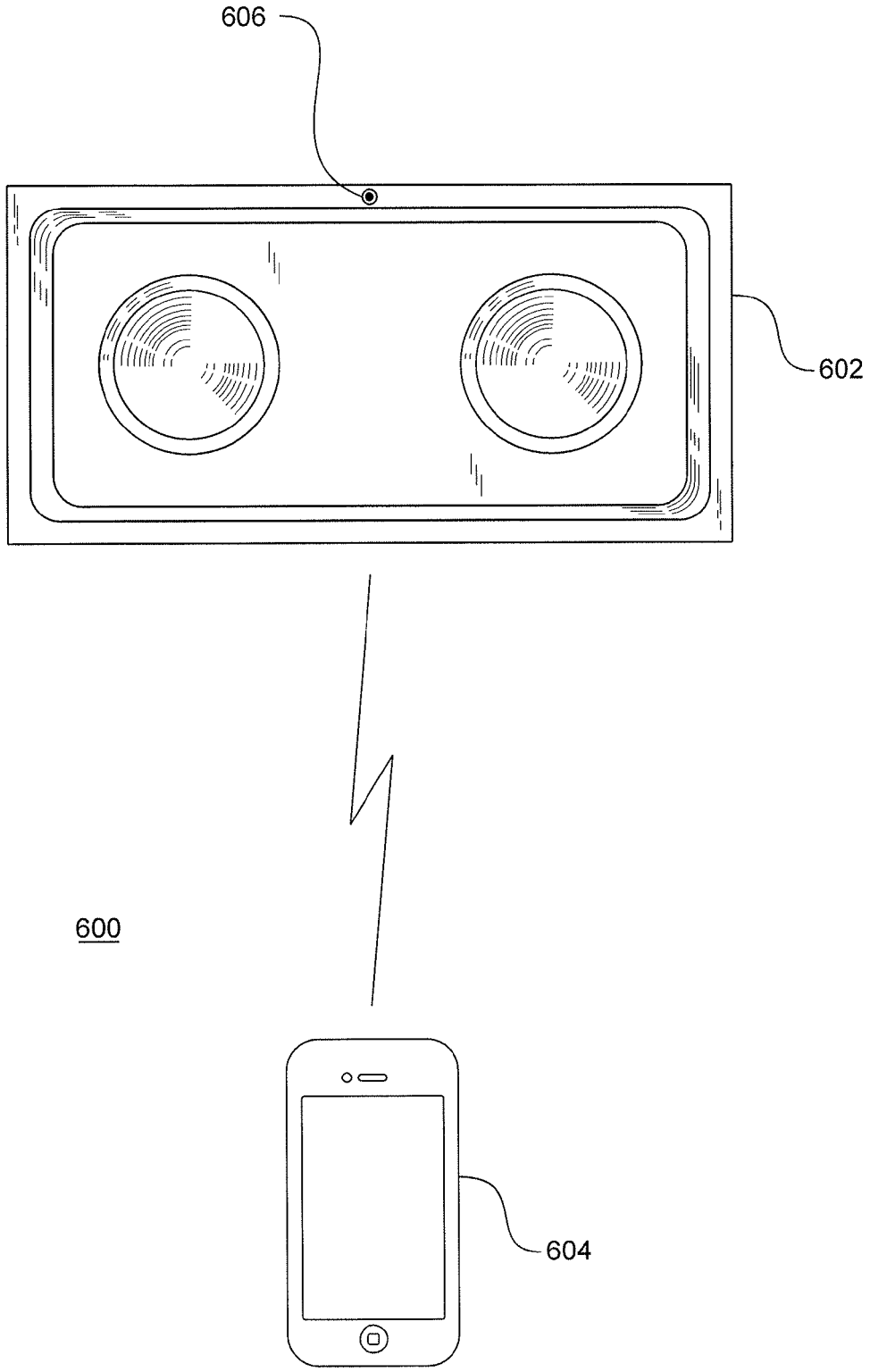
FIG. 6 illustrates a weatherproof loudspeaker system for wireless streaming of audio signals to a weatherproof loudspeaker from a wireless communication device.

FIG. 6 illustrates a weatherproof loudspeaker system 600 for wireless streaming of audio signals to a weatherproof loudspeaker 602 from a wireless communication device 604. The wireless communication device 604 can be a mobile phone, a digital audio player, or any other wireless-capable audio streaming device. The wireless communication device 604 can stream audio to the weatherproof loudspeaker 602 via a wireless communication protocol, such as BLUETOOTH. Other protocols or wireless communication systems can also be used as described above. The wireless communication device 604 may also control and/or monitor power and signal processing profiles, loudspeaker designation/identification (for multiple loudspeaker scenarios), proximity- or other-based security features, and the like. A software application may be provided for execution by the wireless communication device 604 to implement such controls and monitoring. Additional details of such features are described in greater detail below with respect to FIG. 8.

The weatherproof loudspeaker 602 can be a stereo acoustic suspension system, with at least two active driver speakers within a separately-vibrating passive radiator, as generally described above. Further bass, or lower frequency, enhancement can also be provided by a digital processor circuit and algorithm, such as MaxxBass® from Waves. The weatherproof loudspeaker 602 can also include a microphone 606, or microphone array. In some implementations, the microphone 606 is a MEMS microphone or microphone array, which provides lower mechanical vibration sensitivity, and which picks up less resonance from enclosure vibration to allow echo cancellation algorithms to work better. Further, a MEMS microphone may be utilized as a small acoustic vent to allow for waterproofing.

Figure 7:
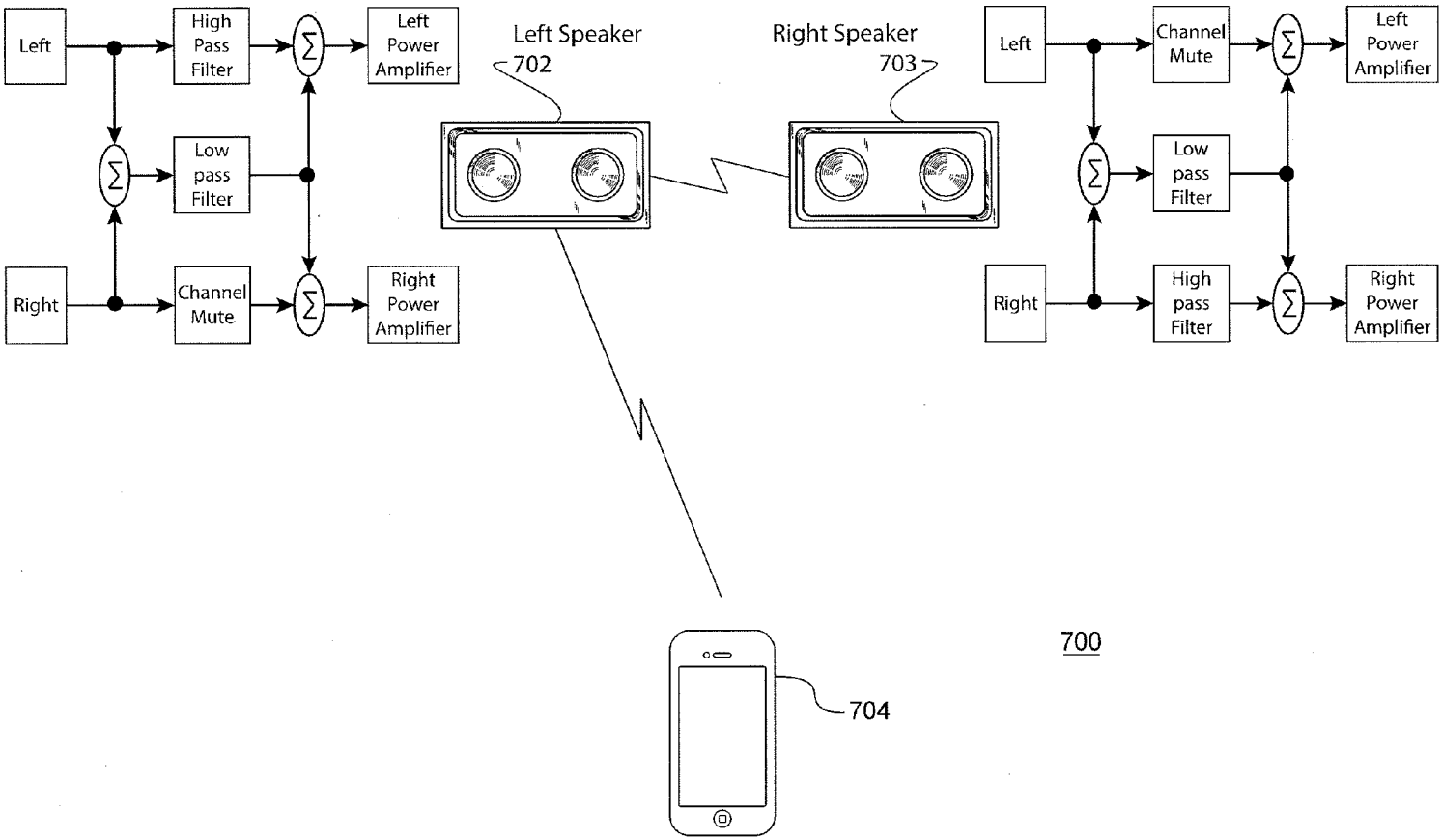
FIG. 7 illustrates a weatherproof loudspeaker system for wireless streaming of stereo audio signals from a wireless communication device to two weatherproof loudspeakers.

FIG. 7 illustrates a weatherproof loudspeaker system 700 for wireless streaming of stereo audio signals from a wireless communication device to two weatherproof loudspeakers. The wireless communication device 704 can transmit, and a first weatherproof loudspeaker 702 can receive, stereo audio transmitted using Bluetooth A2DP Profile or using other wireless protocols such as Wi-Fi Direct. The first weatherproof loudspeaker 702 can retransmit the audio signals to a second weatherproof loudspeaker 703. Alternatively, each loudspeaker 702, 703 can receive the audio signals independently from the wireless communication device. For example, using appropriate communication protocols, each loudspeaker 702, 703 can communicate independently with the wireless communication device. Each loudspeaker 702, 703 may be respectively designated as left or right, etc. such that it plays back the corresponding portion of the audio signal.

In the example shown in FIG. 7, a left loudspeaker 702 accepts the stereo A2DP audio stream and plays the left channel. Wirelessly forwarding the audio signal from one loudspeaker to another may, without compensation, result in a delay in playback between the loudspeakers. Accordingly, the left speaker 702 then retransmits the A2DP stream to the right speaker 703 and delays the left channel playback to compensate for latency and synchronize left/right playback. The signal processing is shown for each of the left and right speakers. Loudspeaker-to-loudspeaker delay, whether resulting from A2DP or other serial or parallel transmission protocols, may be overcome by coordinating playback, e.g., via a timing signal shared by each loudspeaker device. Using the timing signal, the amount of delay can be determined and reported for determination of required compensation. For example, the second loudspeaker 703 may report its determined delay to the first loudspeaker 702, which may then compensate playback timing in the first loudspeaker 702 to match that of the second loudspeaker 703.

In such implementations utilizing more than one weatherproof loudspeaker, each of the active driver speakers in one weatherproof loudspeaker reproduces the same audio channel rather than respectively reproducing left and right channel audio. Instead, the remaining left or right channel audio information reproduced by all active driver speakers of the other weatherproof loudspeaker. The addition of the low frequency information from both channels for playback at both the first and the second weatherproof loudspeakers will increase the overall system bass response. When a speaker has two active drivers in the same horizontal plane that reproduces the same signal, the horizontal off-axis response has a cancellation of frequencies based on the angle of the listener and the distance between the drivers. To eliminate the cancellation, the signal for one weatherproof loudspeaker (i.e., either the left 702 or the right 703 loudspeaker) may go through a lowpass filter at a frequency different from the frequency that would be cancelled. This is sometimes referred to as shading. If the illustrated algorithm does not output the unintended channel, the bass response will still be improved by the shaded driver producing the same content as the full range driver.

Figure 8:
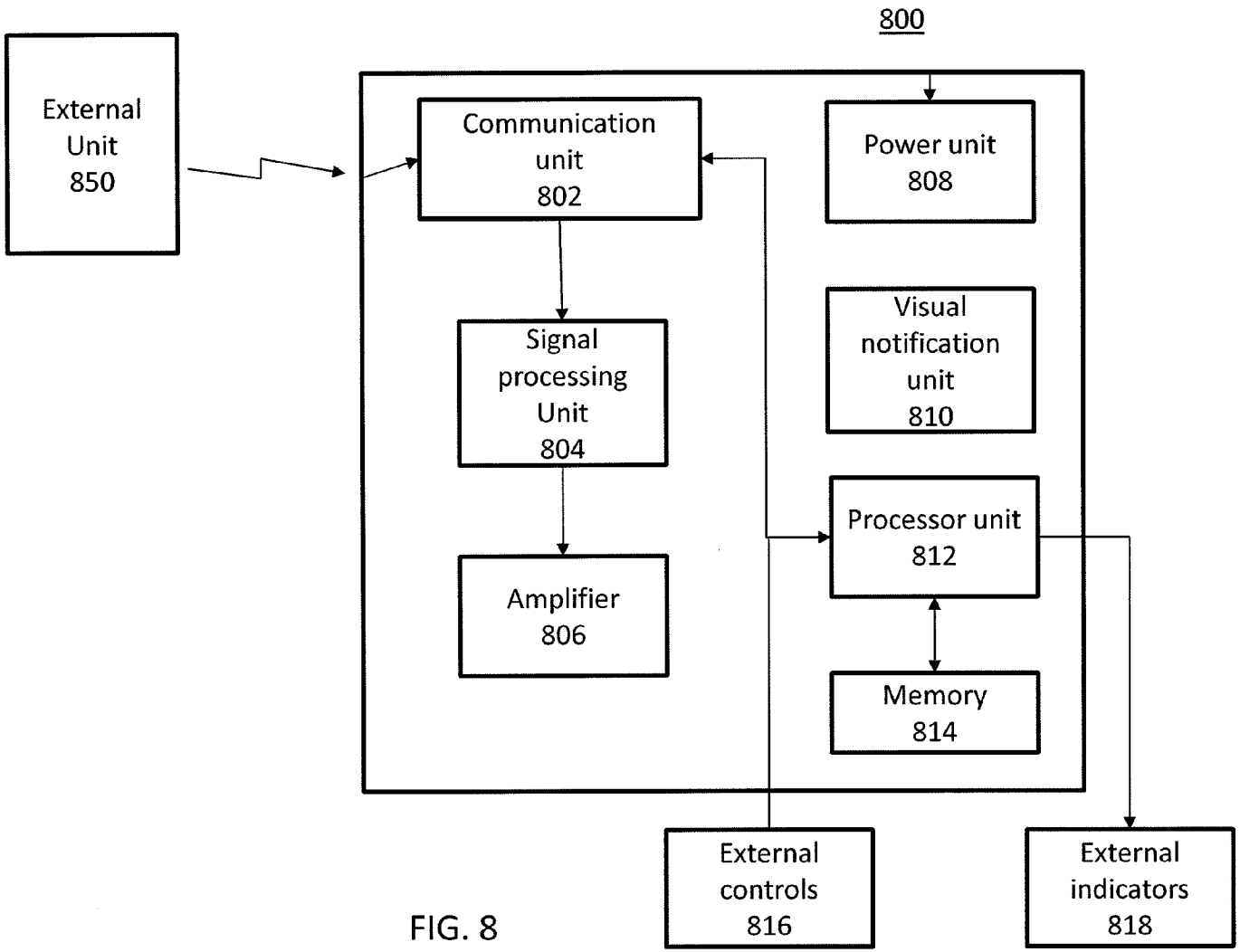
FIG. 8 illustrates a block diagram of a control circuitry for a weatherproof loudspeaker.

Referring to FIG. 8, a weatherproof loudspeaker may include control circuitry 800 configured to provide electrical signals to the weatherproof loudspeaker. The control circuitry may be fixed to a wall of the weatherproof loudspeaker or to structural elements therein. The control circuitry 800 may include one or more of a communications unit 802, a signal processing unit 804, an amplifier 806, power conditioning and management unit 808, visual notification unit 810, processor unit 812 and memory 814.

In some embodiments the weatherproof loudspeaker may be configured to receive an audio signal from an external device 850 via communication unit 802. The communications unit may be configured to receive general broadcast audio (i.e., FM, AM, shortwave, weatherband, etc.) and/or may be configured to receive a wireless signal via BLUETOOTH, Wi-Fi, near field communications (NFC), or other wireless signal via appropriate antennas and radio circuitry. The communication unit 802 may be configured to pair or bond with the external device via a handshaking protocol. Embodiments consistent with this disclosure may include a microphone built into the weatherproof loudspeaker. Additionally, a software application executed by the external device 850 may permit use of a microphone of the external device 850 for capturing and transmitting live audio for playback at the weatherproof loudspeaker. A signal received at the communication unit 802 may be demodulated, decrypted, unpacked and/or reconstructed such that a signal having audio content may be provided to the signal processing unit 804. The communication unit 802 may also include elements for managing telephone calls received at the external device 850. For example, the communication unit 802 may be configured to permit the user to use the weatherproof loudspeaker as a speakerphone, wirelessly receiving and transmitting call information. Other playback, whether or not received from the external device 850, may be interrupted by a telephone call when configured by the user to do so.

The signal processing unit 804 may receive audio content received in the signal provided from the communication unit 802. A general purpose processor and/or digital signal processor of the signal processing unit 804 may receive the digital audio signal and may change elements thereof to enhance or de-emphasize certain frequency bands, extract metadata, introduce audio effects, and the like. In some embodiments the signal processing unit 804 may change the audio signal to compensate for aural artifacts known to be introduced by the weatherproof loudspeaker.

The signal processing unit 804 may implement various user or genre profiles based on entered or determined user preferences or on a detected genre of the audio content. For example, a "classical piano" genre may be detected from music analysis or from metadata provided with audio content. The signal processing unit 804 may then change the digital signal to ensure a tone and effect that complements classical piano music. In another example, a user may have a preference for heavy bass in all types of music, or may have a hearing deficiency in certain frequency ranges. Accordingly, the user may implement a preset or custom equalization profile to enhance or reduce certain frequencies. In another setting, the signal processor may analyze a stereo audio signal and remove portions, such as vocals, that are common to both left and right channels in order to, for example, facilitate sing-along (i.e., karaoke). In yet another setting the signal processor may, as presented above, filter low-frequency portions of a stereo signal, mix them, and add the mixed low-frequency elements to the left- and right-channel high-frequency components such that each loudspeaker may reproduce the full spatial spectrum of low-frequency audio. The signal processing unit 804 may convert the processed signal from a digital signal to an analog signal via a digital-to-analog converter (DAC) and send the processed signal to the amplifier 806. In some cases, the processor may be bypassed so that the signal from the communication unit 802 may be converted to analog directly.

The amplifier 806 may receive the analog audio signal from the signal processing unit. Audio content received in signals from the external unit 850 are not sufficient in amplitude to drive an active driver speaker (such as 112, 311, 312, 412, etc.). The amplifier 806 thus amplifies the signal to a sufficient level for driving the active driver speaker. The amplifier may include amplification units for each audio channel, or may include only a single channel amplifier. In some cases, for example in weatherproof loudspeaker 100 that has only one active driver speaker 112, the amplifier 806 may receive for amplification a mixed-channel audio signal provided by the signal processing unit 804. An output level of the amplifier 806 may be controlled via a control signal from the external device 850 or via a volume/loudness control, e.g., external controls 816, on an exterior of the weatherproof loudspeaker.

The power unit 808 may condition and manage power for the weatherproof loudspeaker, and provide power to all elements of the control circuitry 800. The power unit may include one or more battery interfaces and may manage recharging of rechargeable batteries. Power may be received via a dedicated power connector or via a USB connector on the weatherproof loudspeaker, or may be received wirelessly via an inductive charging coil such as in Qi®, PMA®, or resonant mode charging. Power received may be directed to charging the batteries and powering of the electrical components of the loudspeaker. The power unit 808 may manage output of power from the internal battery/batteries to charge an external device. In some implementations, a surface of the weatherproof loudspeaker may serve as a wireless charging surface for wirelessly charging an external device.

The visual notification unit 810 may provide notifications to a user including an indication of power status, battery level, communication type and/or status, such as a pairing/bonding status. The visual notification unit may control external indicators 818, such as LEDs, a display screen such as an LCD screen. Further, the visual notification unit 810 may control output of lights behind/within translucent elements of the passive radiator or active driver speaker of the weatherproof loudspeaker described above, and/or other visual elements described herein. In some implementations, metadata included with the audio content may include song lyrics, which can be presented via the visual notification unit 810 on a display unit of the weatherproof loudspeaker. In embodiments consistent with the disclosure, the weatherproof loudspeaker may include one or more video outputs, such as HDMI, to permit presentation of lyrics, playlists, request queues and/or other visual content on an external screen.

The processor unit 812 may control elements of the playback and communications described above. The processor may read instructions from a non-transient memory 814 for execution. For example, the processor may in some embodiments execute an operating system and application software. Additionally, the processor unit may control the communication unit 802 for both audio-related and non-audio related functions.

In some implementations, the weatherproof loudspeaker may include in the communications unit 802 two or more receivers of a same type in order to pair/bond simultaneously with more than one external device. For example, the communications unit 802 may include two or more BLUETOOTH receivers for simultaneous connection with two or more external devices. This implementation may permit the weatherproof loudspeaker to receive and manage a playback queue of content received from more than one external device 850. Each BLUETOOTH receiver may alternately be designated an "active" receiver and a "queue" receiver. The active receiver may receive, from a first external device, content for immediate playback, whereas the queue receiver may receive a playback request from a second external device and may hold in queue a requested content for playback. Upon ending or other termination of the content playback from the first external device, the active receiver and queue receiver swap status, the active receiver becoming the queue receiver and vice versa.

An application (or "app") for execution on an external device such as a smartphone may complement the functions of the weatherproof loudspeaker. In some implementations, of course, conventional BLUETOOTH audio bonding and playback may be used to provide audio via the weatherproof loudspeaker. However, a complementary app may be used to implement other features. For example, an app may store and/or facilitate communication of playback profiles implemented at the weatherproof loudspeaker. Further, a BLUETOOTH Low-Energy (BLE, or BLUETOOTH SMART) signal from the weatherproof loudspeaker may be periodically monitored to determine proximity. This monitoring may aid in queue management, and may also be used for security. For example, when the proximity signal is not received, the app may provide an alert to the user indicating potential theft. Also, in a setting where multiple weatherproof loudspeakers may be present, the proximity detection, particularly with a predetermined identifier, may help a user determine a location of the weatherproof loudspeaker. In one exemplary scenario, a user at a beach may leave the weatherproof loudspeaker in "her spot" at a crowded area in order to meet a friend or play volleyball. When the user wishes to return to her spot, she may easily locate the spot using the proximity detection. The app may graphically indicate a "hot or cold" (near or far) indication to help the user determine distance to her weatherproof loudspeaker. The app may also provide means to trigger playback of a predetermined audible signal from the weatherproof loudspeaker when within a set radius from the weatherproof loudspeaker.

Proximity awareness may also be used to aid placement of a loudspeaker for optimal listening. In some implementations multiple loudspeakers may be used for playback of multiple audio channels, such as in home theater or other surround-sound setting. Conventional theater systems often employ a specific microphone and loudspeaker-by-loudspeaker "pink noise" playback for each of left, right, center, left surround and right surround channels. The presently disclosed loudspeakers each may include BLUETOOTH or other wireless communication radios. Accordingly the loudspeakers can be configured to determine their relative positions, and, based on a user designation for at least one loudspeaker and a listening position, can approximate an optimal relative loudness and equalization setting for each loudspeaker.

Further, a user device, such as a smartphone having a microphone, may aid in optimal surround setup. For example, the user device may be used to designate the surround position of at least one of the loudspeakers. In some implementations, the remaining loudspeakers may determine their surround position based on a determination of their relative positions from proximity and triangulation data. That is each loudspeaker may receive a proximity signal from two or more other loudspeakers and may from that data triangulate its relative spatial position. The relative spatial positions can then be used to designate the surround position of each speaker based on the at least one user designated speaker. The user may then trigger pink noise generation from each speaker, using the microphone in the user device to receive the pink noise and either analyze the received pink noise or transmit the received noise to the respective loudspeaker for analysis at the loudspeaker. The analysis may be used to automatically adjust a relative loudness and/or equalization setting for the respective loudspeaker. In some embodiments, the user may adjust the relative settings via an app executed by the user device and may store the settings at the user device or forward the settings to the respective loudspeakers for storage thereat.

Certain embodiments of the weatherproof loudspeaker may accommodate a modular scheme wherein a user may obtain one or more loudspeakers and or accessories that may be combined logically and/or physically to provide various levels of sound reproduction. For example, a loudspeaker having a display may be used as a central loudspeaker module, and a user may add left and right satellite modules, a bass/subwoofer module, a carrying handle, etc. Each unit may include its own battery and communications circuitry such that the units may operate together with no electrical connection by wirelessly communicating control signals and audio signal components. In some embodiments, the units may share power, via physical connection or via inductive sharing. The sharing may be managed such that the power is load balanced. For example, a bass/subwoofer module may require more power than a satellite module. Logic circuitry within each module may cooperate with other modules to share power with the high-need module. Charging of a battery in one module may be managed such that the other modules are also charged. Charging may be performed serially, in parallel, or by highest need (i.e., the battery with lowest level is charged first). Battery charging may be managed to maximize battery lifetime.

Although a few embodiments have been described in detail above, other modifications are possible. Other embodiments may be within the scope of the following claims. For example, the term "weatherproof loudspeaker" has been used throughout the specification. However, many of the features described herein may be applied to loudspeaker devices that are not weatherproof.

The term "about" is used herein to refer to +/−10% of a given measurement, range, or dimension unless otherwise indicated.

The invention claimed is:

1. A weatherproof loudspeaker comprising:

a rigid enclosure having an outer wall that has at least one sealing member configured to prevent ingress of liquids and particulate matter into the rigid enclosure from an external environment; and a liquid-impermeable sound projecting region formed in the outer wall of the rigid enclosure and sealed from the external environment, the liquid-impermeable sound projecting region comprising:

an active driver speaker having a voice coil assembly, the voice coil assembly including a permanent magnet and a voice coil, the voice coil assembly being rigidly connected with the rigid enclosure to limit movement of the voice coil assembly relative to the rigid enclosure, the active driver speaker further having a driver diaphragm configured to be driven by the voice coil to project sound waves outward from the rigid enclosure via a front surface of the driver diaphragm and to modulate air within the rigid enclosure via a rear surface of the driver diaphragm an inner surround that frames the active driver speaker, the inner surround being formed of a first flexible material; and a passive radiator at least partially surrounding the active driver speaker, an inner edge of the passive radiator connected to the inner surround and an outer edge of the passive radiator connected to an outer surround formed of a second flexible material, the outer surround being connected with a structural support frame of the sound projecting region, the structural support frame being securely fixed to the rigid enclosure, the passive radiator having a rigid diaphragm with surface area and a mass that together are configured to tune the passive radiator to have a resonant frequency below a frequency range reproduced by the active driver speaker in the rigid enclosure, the passive radiator configured to enhance at least low-frequency sound waves of the active driver speaker.

2. The weatherproof loudspeaker in accordance with claim 1, wherein to modulate the air includes compression and rarefaction of the air.

3. The weatherproof loudspeaker in accordance with claim 1, wherein the permanent magnet of the voice coil assembly is connected with the rigid enclosure to prevent movement of the permanent magnet and the voice coil relative to the rigid enclosure.

4. The weatherproof loudspeaker in accordance with claim 1, wherein the active driver speaker, passive radiator and inner and outer surrounds provide a seal between an interior of the rigid enclosure and the external environment exterior of the rigid enclosure.

5. The weatherproof loudspeaker in accordance with claim 1, wherein the passive radiator is configured to enhance sound waves that are in a frequency range between 20 and 100 hertz.

6. The weatherproof loudspeaker in accordance with claim 1, wherein the passive radiator is configured to enhance sound waves in a frequency range determined in part by a volume of the rigid enclosure.

7. The weatherproof loudspeaker in accordance with claim 1, wherein the passive radiator is configured to enhance sound waves in a frequency range determined in part by a determined amount of flexibility of the inner and outer surrounds.

8. The weatherproof loudspeaker in accordance with claim 1, wherein a desired frequency response of the passive radiator is characterized at least in part based on the mass of the passive radiator diaphragm, respective flexibility amounts of the inner and outer surrounds, and a volume of the rigid enclosure.

9. The weatherproof loudspeaker in accordance with claim 1, wherein at least one of the active driver speaker diaphragm and the passive radiator diaphragm is translucent.

10. The weatherproof loudspeaker in accordance with claim 9, further comprising one or more light sources housed within the rigid enclosure.

11. The weatherproof loudspeaker in accordance with claim 1, wherein the structural support includes a cylinder affixed at a first cylinder end to a rear portion of the active driver speaker and affixed at a second cylinder end to a wall of the rigid enclosure.

12. The weatherproof loudspeaker in accordance with claim 1, further comprising a gas permeable, liquid-impermeable vent formed in the rigid enclosure.

13. A speaker assembly comprising:

a rigid frame that defines a boundary of a sound projecting region;

an active driver speaker having portions rigidly connected with the rigid frame, the active driver speaker being configured to project sound waves outward from the sound projecting region and to project sound waves rearward from the sound projecting region;

an inner surround formed of a first flexible material that frames the active driver speaker; and a passive radiator that frames the inner surround, an inner edge of the passive radiator connected to the inner surround the passive radiator having a surface area and a mass that together are configured to tune the passive radiator to have a resonant frequency below a frequency range produced by the active driver speaker, the passive radiator configured to enhance outward projection, from the sound projecting region, of a portion of the frequency range produced by the active driver speaker, and an outer surround that frames the passive radiator and that is connected to an outer edge of the passive radiator, the outer surround formed of a second flexible material, the outer surround connected with a perimeter of the rigid frame.

14. The speaker assembly in accordance with claim 13, wherein the active driver speaker includes a truncated-cone shaped diaphragm to project sound outward from the sound projecting region and to project the sound waves rearward.

15. The speaker assembly in accordance with claim 13, wherein the active driver speaker, the inner and outer surrounds and the passive radiator provide a weatherproof seal for the sound projecting region.

16. A weatherproof loudspeaker comprising:

a rigid enclosure having two or more sides, an interface between two of the two or more sides being sealed to prevent ingress of liquid and particulate matter to an internal space of the rigid enclosure from an environment external to the rigid enclosure; and a sound projecting region formed on at least one side of the rigid enclosure, the sound projecting region comprising:

two or more active driver speakers having portions that are rigidly connected with the rigid enclosure, each of the two or more active driver speakers configured to project sound waves outward from the sound projecting region and to project sound waves rearward within the rigid enclosure;

an inner surround formed of a first flexible material that respectively frames each of the two or more active driver speakers; and a passive radiator positioned at least partially surrounding both of the two or more active driver speakers, first inner edges of the passive radiator respectively connected to each inner surround, and an outer edge of the passive radiator connected to an outer surround formed of a second flexible material, the outer surround connected with the rigid enclosure, the passive radiator having a surface area and a mass that together are configured to tune the passive radiator to have a resonant frequency below a frequency range produced by the active driver speakers, the passive radiator being configured to enhance outward projection of a portion of the frequency range produced by the active driver speaker from the sound projecting region.

17. The weatherproof loudspeaker in accordance with claim 16, wherein the two or more active driver speakers, passive radiator, and inner and outer surrounds together provide a liquid-impermeable and particle-impermeable seal between an interior of the rigid enclosure and the environment external to the rigid enclosure.

18. The weatherproof loudspeaker in accordance with claim 16, wherein the enhanced portion of the frequency range of the active driver speaker includes frequencies between 20 and 100 hertz.

19. The weatherproof loudspeaker in accordance with claim 16, wherein the enhanced portion of the frequency range of the active driver speaker is based in part on a volume of the rigid enclosure.

20. The weatherproof loudspeaker in accordance with claim 16, wherein the projection of the enhanced portion of the frequency range of the active driver speaker by the passive radiator is based in part on the flexibility of the inner and outer surrounds.

21. The weatherproof loudspeaker in accordance with claim 16, wherein a desired frequency response of the passive radiator is characterized at least in part based on the mass of the passive radiator, an amount of flexibility of the inner and outer surrounds, and a volume of the rigid enclosure.

22. The weatherproof loudspeaker in accordance with claim 16, wherein at least a diaphragm of the passive radiator is formed of a translucent material.

23. The weatherproof loudspeaker in accordance with claim 22, further comprising one or more light sources housed within the rigid enclosure, the one or more light sources being positioned to permit direct or reflected light emitted by the one or more light sources to be transmitted through at least the translucent diaphragm.

24. The weatherproof loudspeaker in accordance with claim 16, further comprising a support frame connected between each of the two or more active driver speakers and the rigid enclosure.

25. The speaker in accordance with claim 24, wherein the support frame includes a tube having at least one aperture to allow passage of air within the rigid enclosure.

26. A weatherproof loudspeaker comprising:

a rigid enclosure having a sound projecting region;

two or more active driver speakers each mounted in the sound projecting region via a respective inner surround, each active driver speaker having a cone-shaped diaphragm configured to project sound outward from the sound projecting region and to compress and rarefy air within the rigid enclosure, each active driver speaker having a predetermined mass; and a passive radiator having an outer edge connected to a flexible suspension, and having inner edges respectively connected to the inner surrounds of the two or more active driver speakers, the passive radiator being formed to cooperate with the respective inner surrounds and the two or more active driver speakers, the passive radiator configured to react to the compressed and rarefied air to project at least a portion of the reflected sound waves within the rigid enclosure outward from the sound projecting region as sound waves within a predetermined frequency range at a predetermined frequency response.

27. A weatherproof loudspeaker comprising:

a rigid enclosure having an outer wall that is sealed to inhibit ingress of water and particulate matter from an external environment and having a sound projecting region;

one or more speaker assemblies, each speaker assembly including at least one active driver speaker, each active driver speaker having a diaphragm movable to project sound outward from the sound projecting region and to compress and rarefy air within the rigid enclosure, each active driver speaker having a predetermined mass;

a flexible suspension that frames at least part of the sound projecting region; and a passive radiator having an outer edge connected to the flexible suspension and having one or more inner edges respectively connected to the one or more speaker assemblies, the passive radiator being formed to cooperate with the flexible suspension and the one or more speaker assemblies to project sound waves outward from the sound projecting region based on the compression and rarefaction of air within the rigid enclosure within a predetermined frequency range.

28. The weatherproof loudspeaker in accordance with claim 27, further comprising a second flexible suspension framing an outer periphery of the passive radiator.

* * * * *